US007249730B1

(12) United States Patent
Flippen, Jr.

(10) Patent No.: US 7,249,730 B1
(45) Date of Patent: Jul. 31, 2007

(54) SYSTEM AND METHOD FOR IN-FLIGHT TRAJECTORY PATH SYNTHESIS USING THE TIME SAMPLED OUTPUT OF ONBOARD SENSORS

(75) Inventor: Luther D. Flippen, Jr., Waldorf, MD (US)

(73) Assignee: United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/947,128

(22) Filed: Sep. 23, 2004

(51) Int. Cl.
*F41G 7/00* (2006.01)
*F42B 15/01* (2006.01)
*G01S 13/00* (2006.01)

(52) U.S. Cl. ..... 244/3.15; 244/3.1; 244/3.16; 244/3.19; 342/61; 342/62; 342/165; 342/173; 342/175; 342/195

(58) Field of Classification Search ..... 244/3.1–3.3, 244/63; 342/59, 61–68, 118–122, 165–175, 342/195, 450–465, 82–103; 700/30, 44, 700/73

See application file for complete search history.

(56) References Cited

U.S. PATENT DOCUMENTS 3,291,419 A * 12/1966 Montague et al. ..... 244/3.15
3,926,121 A * 12/1975 McCracken ..... 342/68
3,990,657 A * 11/1976 Schott ..... 244/3.15
4,008,869 A * 2/1977 Weiss ..... 244/3.13
4,168,663 A * 9/1979 Kohler ..... 342/68
4,456,202 A * 6/1984 Price et al. ..... 244/3.15
4,634,946 A * 1/1987 Moulds et al. ..... 700/30
4,655,411 A * 4/1987 Franzen et al. ..... 244/3.11
5,233,901 A 8/1993 Nilsson et al.

(Continued)

FOREIGN PATENT DOCUMENTS

EP 0751367 A1 * 1/1997

(Continued)

OTHER PUBLICATIONS

Wan, E.A., et al., "The Unscented Kalman Filter for Nonliner Estimation," In Proc. of IEEE Symposium 2000 (AS-SPCC), pp. 153-158, Lake Louise, Alberta, Canada, Oct. 2000.

(Continued)

*Primary Examiner*—Bernarr E. Gregory
(74) *Attorney, Agent, or Firm*—William Randolph

(57) ABSTRACT

Disclosed are a system, method, and program storage device implementing the method, of data fusion, wherein the method comprises determining pre-launch data affecting a flight of a self-sensing air-bursting ballistic projectile, the projectile comprising a plurality of independent data sensors; predicting a trajectory path of the projectile based on a target location of the projectile; calculating trajectory path errors based on the predicted trajectory path; generating in-flight data from each of the data sensors; combining the in-flight data into a single time-series output using a fusion filter; tracking a trajectory position of the projectile based on the single time-series output, pre-launch data, and the trajectory path errors; comparing the tracked trajectory path with the predicted trajectory path; analyzing the in-flight data to gauge successful navigation of the projectile to the target location; and self-guiding the projectile to the target location based on the trajectory position.

32 Claims, 11 Drawing Sheets

U.S. PATENT DOCUMENTS

| | | | | |
|---|---|---|---|---|
| 5,424,942 | A * | 6/1995 | Dong et al. | 700/44 |
| 5,451,014 | A | 9/1995 | Dare et al. | |
| 5,631,654 | A * | 5/1997 | Karr | 342/90 |
| 5,762,290 | A * | 6/1998 | Dupont | 244/3.15 |
| 5,787,785 | A | 8/1998 | Muenzel et al. | |
| 5,920,027 | A * | 7/1999 | Maas | 342/67 |
| 5,938,148 | A * | 8/1999 | Orenstein | 244/3.15 |
| 6,085,629 | A | 7/2000 | Thiesen et al. | |
| 6,209,820 | B1 * | 4/2001 | Golan et al. | 244/3.15 |
| 6,216,595 | B1 | 4/2001 | Lamorlette et al. | |
| 6,262,680 | B1 * | 7/2001 | Muto | 244/3.1 |
| 6,427,598 | B1 | 8/2002 | Boss | |
| 6,614,012 | B2 * | 9/2003 | Schneider et al. | 244/3.1 |
| 6,672,533 | B1 * | 1/2004 | Regebro | 244/3.13 |
| 2003/0057320 | A1 * | 3/2003 | Schneider et al. | 244/63 |

FOREIGN PATENT DOCUMENTS

EP 0978731 A1 * 2/2000

OTHER PUBLICATIONS

Davis, B.S., et al., "Shock Experiment Results of the DFuze 8-Channel Inertial Sensor Suite that Contains Commercial Magnetometers and Accelerometers," Memorandum Report ARL-MR-532, U.S. Army Research Laboratory, Aberdeen Proving Ground, MD, Apr. 2002.

Hepner, D.J., et al., "Determining Inertial Orientation of a Spinning Body with Body-Fixed Sensor," Technical Report ARL-TR-2313, U.S. Army Research Laboratory, Aberdeen Proving Ground, MD, Jan. 2001.

Thompson, A.A., "A Point-wise Solution for the Magnetic Field Vector," Technical Report ARL-TR-2633, U.S. Army Research Laboratory, Aberdeen Proving Ground, MD, Jan. 2002.

Thompson, A.A., "A Procedure for Calibrating Magnetic Sensors," Memorandum Report ARL-MR-524, U.S. Army Research Laboratory, Aberdeen Proving Ground, MD, Jan. 2002.

* cited by examiner

SYSTEM AND METHOD FOR IN-FLIGHT TRAJECTORY PATH SYNTHESIS USING THE TIME SAMPLED OUTPUT OF ONBOARD SENSORS

GOVERNMENT INTEREST

The invention described herein may be manufactured, used, and/or licensed by or for the United States Government.

BACKGROUND OF THE INVENTION

1. Field of the Invention

The invention generally relates to sensor systems, and more particularly to systems and methods of attaining data fusion from sensor suites onboard ballistic projectiles.

2. Description of the Related Art

Within this application several publications are referenced by Arabic numerals within brackets. Full citations for these and other publications may be found at the end of the specification immediately preceding the claims. The disclosures of all these publications in their entireties are hereby expressly incorporated by reference into the present application for the purposes of indicating the background of the invention and illustrating the general state of the art.

For application to small/medium caliber, air bursting munitions, for which neither Global Positioning System (GPS) based location sensors nor height-above-ground (HOB) proximity sensors are practical, there is an acute need for both an accurate range-sensing fuze during direct fire use, and for an accurate altitude-sensing fuze during large-target-range barrage use. This need arises from the sensitive dependence of lethality upon the range and altitude errors in burst point location for the direct fire and barrage cases, respectively. Conventional fuzing methodology use a computed nominal trajectory simulation, based upon nominal initial/Met (meteorological) conditions, to determine either a time-to-target or a turns-count-to-target value which is communicated to the projectile before firing. The onboard sensor, timer or turns-counter, merely serves as a gauge as to when this value has been reached by the projectile. The breadth of non-trivial range-error sources and altitude-error sources makes it difficult, however, to obtain highly accurate range or altitude predictions using only a single fuze sensor, such as a timer or an ambient electric/magnetic field sensor to count turns of the spin-stabilized projectile.

In exterior ballistics the trajectory of a projectile is defined to be a complete prescription of its rigid body motion (six degrees of freedom) as a function of time starting at gun exit. Three of the degrees of freedom determine the projectile's center-of-mass momentum vector and the other three determine the projectile's angular momentum vector about the center-of-mass. As the projectile's mass and moment of inertia are presumed known, this is equivalent to knowing the combined histories of its velocity vector and angular velocity (spin) vector. Assuming that the gun's location and the projectile's initial orientation are known, the center-of-mass position vector and orientation for the projectile for subsequent times can hence also be deduced. The in-flight prediction of all or part of this information, or information derived thereof, is a problem of paramount importance for military applications. The synthesis of such information from the output of one or more sensors onboard the projectile constitutes trajectory self-sensing, or onboard ballistic navigation.

One of the uses of trajectory sensing is as a feedback to an active guidance control system for correcting the flight path of the projectile so that it accurately reaches its target destination. In the absence of an active guidance control capability, onboard ballistic navigation can still be utilized for either fuze-sensing or the (inverse) problem of inferring projectile aerodynamic coefficients from (field test) sensor output data. The term "fuze-sensing" is meant to convey unguided projectile trajectory self-sensing for the specialized purpose of gauging the attainment of a targeted trajectory condition by the projectile during its flight, the attainment of which signals projectile detonation. This targeted condition is usually chosen so as to maximize the lethality of the detonation. Impact delay and point detonation are the two contact-sensing fuze modes, which do not require knowledge of the projectile's trajectory. Excluding these modes, trajectory self-sensing further specializes to the role of air burst fuze-sensing. Air burst fuze-sensing, in turn, can be further subdivided into direct fire and indirect fire applications, the direct fire case typically being that of nearly straight trajectories with small gun elevations.

Airburst lethality for targets under direct fire is much more sensitive to range error than it is to either altitude or deflection error. It is hence more optimal with respect to lethality to sense range as a target condition than it is to sense either altitude or deflection. Sensors currently used for air burst range sensing can be divided into two classes. In the first class sensors directly probe their environment by sending/receiving signals (typically RF signals), as in the case of proximity sensors, or they receive man-made signals from known, "friendly" sources such as GPS satellites. Active sensors are included in this class. Sensor suites from this class usually have the advantages of direct measurement of projectile (relative or absolute) position and high accuracy. However, these sensors do have their disadvantages as well including that the dependence of these sensors upon external signals means that they are susceptible to jamming, hence a backup fuze-sensing system is advisable. Also, clutter (such as tree canopies) can reduce the reliability of proximity sensors or hinder projectile tracking.

In addition, small volume, shape-conformity, low unit cost, gun ruggedness (high acceleration tolerance), and low power consumption constraints on the onboard sensors and their associated electronics severely limit the options available for in-flight trajectory sensing, and hence range-sensing in particular. The severity of these constraints grows dramatically with the inverse of the caliber of the munition(s), the smallest caliber munitions having the most severe constraints. These constraints tend to preclude the use of sensors from this first class in many small/medium caliber munitions. On the other hand, passive sensors, such as accelerometers and turn counters (for spin stabilized munitions) do not suffer from these deficiencies. However, trajectory information must be indirectly inferred from their output.

Numerous factors determine the trajectory path that a particular projectile takes for a given round within a particular occasion. For example, parameter values representing the projectile's inherent aerodynamic/mechanical response (mass, moments of inertia, various drag coefficients, etc.) influence the trajectory. They arise from the projectile's geometry, design, manufacturing process, and the influence of its immediate environment during its flight. Met (meteorological) data such as air pressure, air temperature, wind velocity humidity, and possibly their local spatial distributions (down-range data) hence also determine the particular trajectory taken. Finally, initial condition data such as gun location, quadrant elevation, gun azimuth, muzzle exit velocity magnitude, and initial spin rate altogether affect the trajectory as well. These latter two are related by:

$$\text{initial spin rate (Hz)} = c\frac{\text{muzzle exit velocity magnitude (m/s)}}{\text{barrel twist (cal/rev)}}$$

where $$c = \frac{1000\ \text{(mm/m)}}{\text{caliber of munition (mm/cal)}}.$$

Target data, such as slant range to target and target elevation are used to determine quadrant elevation and possibly gun azimuth, and hence can be considered as pre-conditional to the initial condition data. Two common trajectory simulation models[2,3] with wide usage are the full 6-dof (degree of freedom) model and the 4-dof modified point mass (MPM) model.

However, three of the biggest causes of differences between trajectory predictions for a given model and actual test flight trajectories arise from (1) the lack of accurate, flight-test-corrected aerodynamic data in the model; (2) inaccuracy/uncertainty of Met/initial-condition data in the model; and (3) the limitations of the model itself. For a given occasion, a fire control computer will measure/sense as much of the baseline information as is practical for that particular gun system, so that some of the pre-flight-determined components of the projectile's flight are known to within various error measurement tolerances. The fire control computer will presume/estimate the remaining pre-flight baseline data and the downrange data that it needs in order to compute a unique nominal (baseline) trajectory that, by definition, passes through both the targeted range and targeted altitude simultaneously for that occasion. It may also correct the gun azimuth of the nominal trajectory for wind, predicted drift (end-of-flight deflection), etc. as well. If the fire control computer were omnipotent then there would be no computational errors, so that the actual trajectory taken by the projectile would match that of the computed nominal trajectory. Moreover, ballistic navigation would then be deterministic, so that there would be no need for sensors onboard the projectile. Unfortunately, the actual trajectory taken by the projectile differs from the computed nominal trajectory mainly due to differences between the measured projectile flight and the actual projectile flight.

Furthermore, conventional range sensing methods are generally based upon the use of the pre-flight-computed nominal trajectory and the in-flight measurement of a "gauge variable" in order to determine when the targeted range value has been attained by the projectile. A gauge variable is a variable that quantitatively gauges the progress of a projectile along all, or some portion of, its trajectory path. As an example, if a given trajectory is divided into two pieces at the point of maximum altitude then the pre-maximum altitude constitutes a separate gauge variable from the post-maximum altitude. Time itself is the most obvious and basic global gauge variable. In fact, the conventional passive range sensing methods consists of an onboard timer gauging the attainment of a predetermined time-to-target value (estimated from the nominal trajectory).

Conventional methods of range sensing generally monitor agreement between the evolving, in-flight-measured value of a gauge variable and that fixed value of the gauge variable corresponding to the targeted range value, as computed from the nominal trajectory. When agreement is indicated, a "fire" signal is generated to initiate detonation. The main difference between these methods is in the choice of the gauge variable. However, a problem that may occur with conventional approaches is that the nominal trajectory, upon which they depend, may be significantly in error due to the accumulated effect of numerous error sources. Efforts to correct this, for example, currently consist of singling out one of the major sources of error, such as the statistical variations in muzzle exit velocity magnitude, and minimizing its effects.

Conventional range sensing methods can be mathematically expressed as follows: for timing, $\theta^*=t^*$, where $\theta^*$ is the target gauge value and t is the time variable with t=0 at the gun exit. For turns counting, $\theta^*=TC^*$, where TC is the turns count starting from TC=0 at the gun exit. For corrected timing, $\theta^*=(V_{nom}/V_{actual})t^*$, $V_{nom}$ is the nominal muzzle exit velocity magnitude, $V_{actual}$ is the actual (measured) muzzle exit velocity magnitude, and $t^*$ is the time-to-target for ordinary (uncorrected) timing. For time-turns hybrid, $\theta^*=TC^*$ if $R_{target}$ is in the supersonic portion of the nominal trajectory, where $R_{target}$ is the target range. If $R_{target}$ is in the subsonic portion of the nominal trajectory, then one measures $\theta=TC$ until $\theta=TC_{M=1}$, at which point $\theta$ resets to $\theta=\delta t$ (the measured elapsed time from the transition at $\theta=TC_{M=1}$) until reaching the final target value $\theta^*=\delta t^*=t^*-t_{M=1}$, where $TC_{M=1}$ and $t_{M=1}$ are the turns count and time, respectively, at Mach one (M=1) and where $t^*$ is the time-to-target-range (all three as determined by the nominal trajectory). The pre-flight computed values for $TC_{M=1}$ and $\delta t^*$ would be passed to the projectile. For a 1D accelerometer, $\theta^*=(\int\int accel)^*$, where $\int\int accel$ is the twice time-integrated value of the acceleration component along the projectile's major axis, the corresponding muzzle exit velocity component from the nominal trajectory being used as one of the constants of integration, wherein it is assumed that the accelerometer is at the projectile's center-of-gravity. With these range sensing methods, the onboard sensor generally acts as a gauge of $\theta$ values with the onboard signal processor acting as a sentinel waiting for the value $\theta=\theta^*$ to be attained.

One of the concepts of fuze-sensing is that of deciding in-flight from sensor readings when the projectile has attained a condition of maximum lethality with respect to its detonation location. This is approximately achieved by monitoring the progression of the value of a particular gauge variable so as to determine when this value has attained a pre-established value. The particular gauge variable used for this purpose, denoted here as $\theta_{lethal}$, is chosen so as to approximately maximize lethality sensitivity with respect to perturbations (errors) in $\theta_{lethal}$ about an optimal detonation value of $[\theta_{lethal}]_{target}$, which is pre-established by targeting data. Practically, $\theta_{lethal}$ could represent range, altitude, or perhaps something more sophisticated. Unfortunately, there is usually no single sensor, which can directly measure the value of $\theta_{lethal}$. To remedy this, the conventional practice is to instead monitor the progress of another gauge variable, denoted here as $\theta_{sensor}$, whose value can be measured directly (or with reasonable signal processing) from sensor output. Given sufficient targeting data, a value for $[\theta_{lethal}]_{target}$ is pre-computed, a nominal trajectory is determined, and the value:

$[\theta_{sensor}]_{target}$=nominal trajectory value $\theta_{sensor}$ at which $\theta_{lethal}=[\theta_{lethal}]_{target}$ is then pre-computed and passed to the projectile. The fuze subsequently determines when the condition:

$$[\theta_{sensor}]_{measured}=[\theta_{sensor}]_{target}$$

has been attained during flight. As previously indicated, the problem with this standard practice is that when the above condition is actually attained one usually has a significant, nonzero error:

$$|\theta_{lethal}-[\theta_{lethal}]_{target}|>0$$

due to the difference between the nominal (pre-computed) trajectory and the actual trajectory taken by the projectile. A common strategy to remedy this is to choose $\theta_{sensor}$ so as to be insensitive to the largest source of error for $\theta_{lethal}$.

Ultimately, there are two main issues pertaining to range sensing accuracy that are not addressed by any of these methods individually. First, not only are there many error sources leading to a significant cumulative range error, but a significant number of them are each individually significant contributors to range error. Second, sensing a gauge variable merely to detect a target value is a waste of valuable information, and using onboard resources merely as a sentinel is a waste of computing potential. In fact, the significant increases in computing power and decreases in unit cost and size that have occurred in digital signal processors (DSP) and central processing units (CPU) have vastly increased in-flight computing potential. This potential has largely been unexploited in conventional range sensing strategies. Therefore, due to the limitations of the conventional systems and methods, there is a need for a novel projectile trajectory tracking methodology, which overcomes the above-identified deficiencies of the conventional methods.

SUMMARY OF THE INVENTION

In view of the foregoing, an embodiment of the invention provides a method of data fusion and a program storage device readable by computer and implementing the method of data fusion, wherein the method comprises determining pre-launch data affecting a flight of a self-sensing projectile, the projectile comprising a plurality of independent data sensors; predicting a trajectory path of the projectile based on a target location of the projectile; calculating trajectory path errors based on the predicted trajectory path; generating in-flight data from each of the data sensors; combining the in-flight data into a single time-series output; and tracking a trajectory position of the projectile based on the single time-series output, pre-launch data, and the trajectory path errors. The method further comprises comparing the tracked trajectory position with the predicted trajectory path; analyzing the in-flight data to gauge successful navigation of the projectile to the target location; and self-guiding the projectile to the target location based on the tracked trajectory position.

The pre-launch data comprises range wind data, crosswind data, temperature data, and pressure data. Moreover, the target location comprises a target range and a target altitude location. The step of combining occurs in a fusion filter. The data sensors comprise any of a timer operable for generating time data and corrected time data of the projectile, a turns counter operable for generating magnetic turns count data of the projectile, and an accelerometer operable for generating acceleration data of the projectile. Furthermore, the pre-launch data, the target location, predicted trajectory path data, and trajectory path error data are transmitted to the projectile from a fire control computer remotely located from the projectile prior to launch. Additionally, the projectile comprises any of air bursting munitions, ballistic munitions, and unguided munitions. Also, the self-sensing projectiles comprise fuze-sensing projectiles. Moreover, the self-sensing projectiles comprise range sensing, altitude sensing, and a combination of both. The step of combining in-flight data produces a collective prediction of the trajectory position as a function of time-from-launch, and the step of combining in-flight data also comprises a fusion of time-sampled outputs from an arbitrary suite of the data sensors, wherein the time-sampled outputs comprise a time-labeled, finite sequence of real numbers for a predetermined set of unique time sample values.

Another embodiment of the invention provides a method for tracking a trajectory position of a fuze-sensing projectile, wherein the method comprises determining a target range and target altitude location for the projectile, wherein the projectile comprises a plurality of data sensors; predicting a trajectory path of the projectile based on the target range and altitude location; determining initial conditions data affecting the projectile prior to launch; calculating trajectory path errors based on the target range and altitude location, the predicted trajectory path, and the initial conditions data; generating in-flight sensor output data generated by each of the data sensors; combining the in-flight sensor output data into a single time-series output calculation; and determining a trajectory flight position of the projectile based on a combination of the initial conditions data, the single time-series output calculation, and the trajectory path errors.

In another embodiment, the invention provides a system for tracking a trajectory position of a fuze-sensing projectile comprising means for determining pre-launch data affecting a flight of the fuze-sensing projectile, the projectile comprising a plurality of independent data sensors; means for predicting a trajectory path of the projectile based on a target location of the projectile; means for calculating trajectory path errors based on the predicted trajectory path; means for generating in-flight data from each of the data sensors; means for combining the in-flight data into a single time-series output; and means for determining a trajectory position of the projectile based on the single time-series output, pre-launch data, and the trajectory path errors. The system further comprises means for comparing the trajectory position with the predicted trajectory path; means for analyzing the in-flight data to gauge successful navigation of the projectile to the target location; and means for self-guiding the projectile to the target location based on the trajectory position.

Generally, the invention is a method for the in-flight fusion of time-sampled outputs from an arbitrary suite of onboard sensors into a collective prediction of projectile position as a function of time-from-launch. The performance of this sensor fusion capability is superior, in terms of accuracy and robustness, to that arising from any one particular individual sensor within the onboard suite. The method itself is independent of the number of, or nature of, the sensors in the suite. In particular, the invention makes only the minimal assumption that the ultimate (possibly signal-processed) output of each sensor comprises a time-labeled, finite sequence of real numbers for a pre-determined set of unique time sample values. One of the many applications of the invention is the fusion of a suite of onboard fuze sensors into an accurate range-sensing fuze, an accurate altitude-sensing fuze, or both. Moreover, the invention provides for the reduction in the amount of data transferred to the ground by the fire control computer for each occasion, and/or for using pre-computed, stored results to reduce/eliminate the computational/information-transfer burden placed upon the fire control computer. Obviously, this could be useful for future systems, as well as for retrofits to existing/older systems, which were not originally designed with the invention in mind.

The invention indicates that combining the output of several independent fuze sensors lead to both improved accuracy and greater robustness, thus overcoming limitations of conventional fuze-sensing methods. Numerous Monte Carlo simulations testing the validity of the invention indicate that the invention can both make use of, and improve upon, current timer and GMR (giant magnetoresistance) magnetometer sensor technology. As MEMS (micro electromechanical systems) accelerometer and other sensor technologies mature for gun rugged use, they can easily be added to existing onboard sensor suites. As such, the invention can then be used to combine the sensors' time-series outputs into a single, collective time-to-detonate decision that is even more robust and accurate than before.

In addition to these small/medium caliber benefits, the invention provides potentially cheaper, more compact, non-jammable, low power alternatives to existing fuze sensors even for large caliber munitions. For example, a GPS based fuzing system, which can be jammed, may be replaced by a collection of cheaper, non-jammable sensors (timing, turns counting, etc.) whose collective fuzing performance is made comparable to that of GPS by application of the invented method. Similarly, the conventional HOB (height above ground) proximity sensor, which is jammable and also susceptible to premature detonation due to tree clutter, may also be replaced by a collection of cheaper, smaller, non-jammable sensors, which are accurate even for ground targets within dense forests. Moreover, the invention accounts for and corrects multiple error sources simultaneously. Additionally, the invention provides an accurate longer range (1500 m and beyond) range-sensing and/or altitude-sensing fuze which also satisfies the practical constraints associated with small/medium caliber, air bursting munitions.

The sensor fusion output of the invention may be used as an accurate range-sensing fuze for direct fire use, altitude-sensing fuze for barrage use, and/or dual-use fuze that combine both capabilities. As the method itself is independent of the number of, or nature of, the onboard sensors, it can form the basis of a universal fuze design for all calibers of munitions, a long sought goal of the munitions fuze community. The invention has the potential use in the determination of aerodynamic coefficients from in-flight sensor data for prototype munitions during field tests. Also, the invention may be used as a trajectory path sensor for use in active flight control/correction as well. In general, the method is useful for any application that requires the accurate sensing of projectile position as a function of time-from-launch.

These, and other aspects and advantages of the invention will be better appreciated and understood when considered in conjunction with the following description and the accompanying drawings. It should be understood, however, that the following description, while indicating preferred embodiments of the invention and numerous specific details thereof, is given by way of illustration and not of limitation. Many changes and modifications may be made within the scope of the invention without departing from the spirit thereof, and the invention includes all such modifications.

BRIEF DESCRIPTION OF THE DRAWINGS

The invention will be better understood from the following detailed description with reference to the drawings, in which:

FIG. 1(*b*) is a flow diagram illustrating an alternative method of the invention;

DETAILED DESCRIPTION OF PREFERRED EMBODIMENTS OF THE INVENTION

Figure 1A:
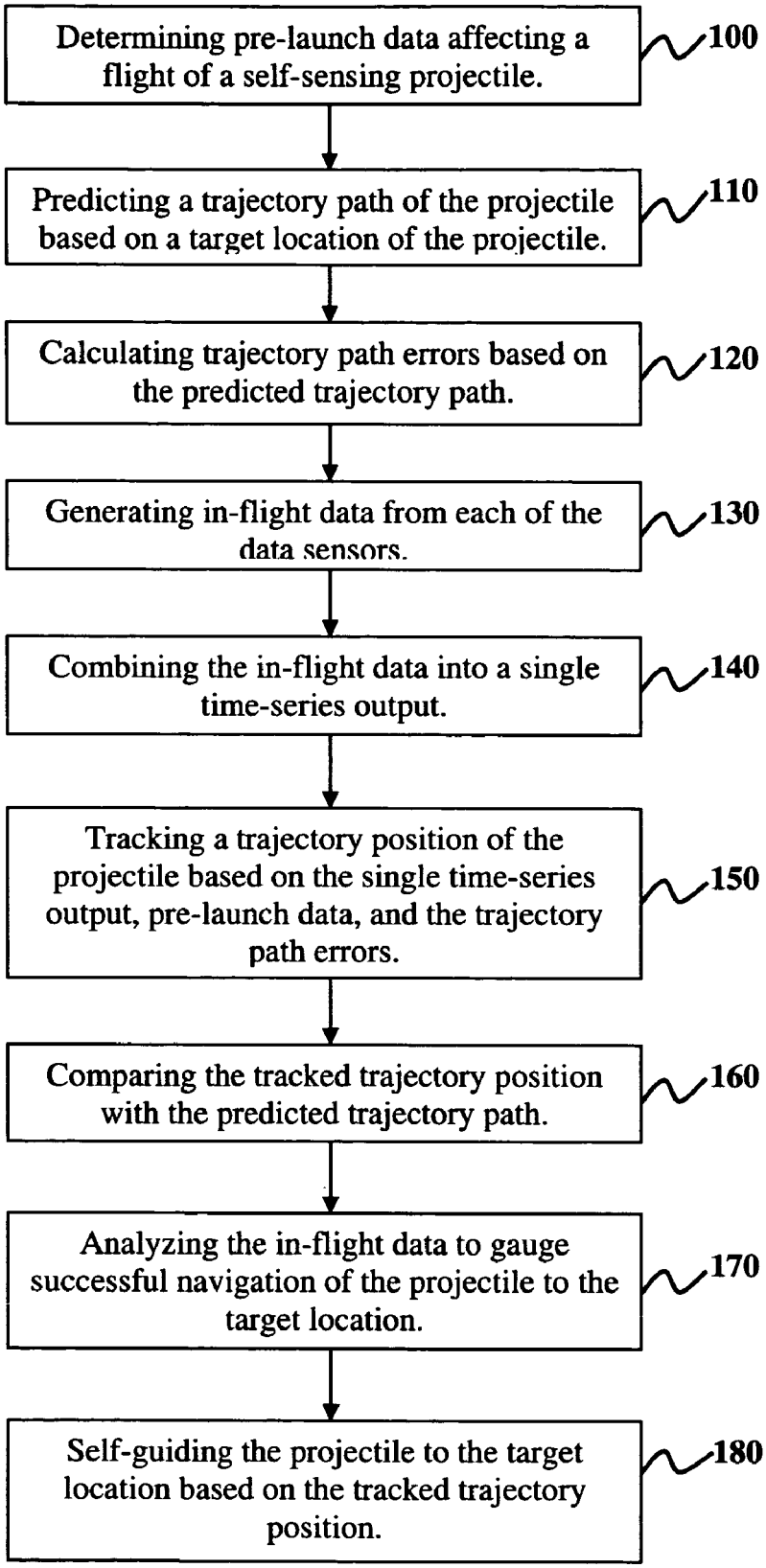
FIG. 1(*a*) is a flow diagram illustrating a preferred method of the invention.

The invention and the various features and advantageous details thereof are explained more fully with reference to the non-limiting embodiments that are illustrated in the accompanying drawings and detailed in the following description. It should be noted that the features illustrated in the drawings are not necessarily drawn to scale. Descriptions of well-known components and processing techniques are omitted so as to not unnecessarily obscure the invention. The examples used herein are intended merely to facilitate an understanding of ways in which the invention may be practiced and to further enable those of skill in the art to practice the invention. Accordingly, the examples should not be construed as limiting the scope of the invention. Referring now to the drawings, and more particularly to FIGS. 1 through 10, there are shown preferred embodiments of the invention.

Figure 1B:
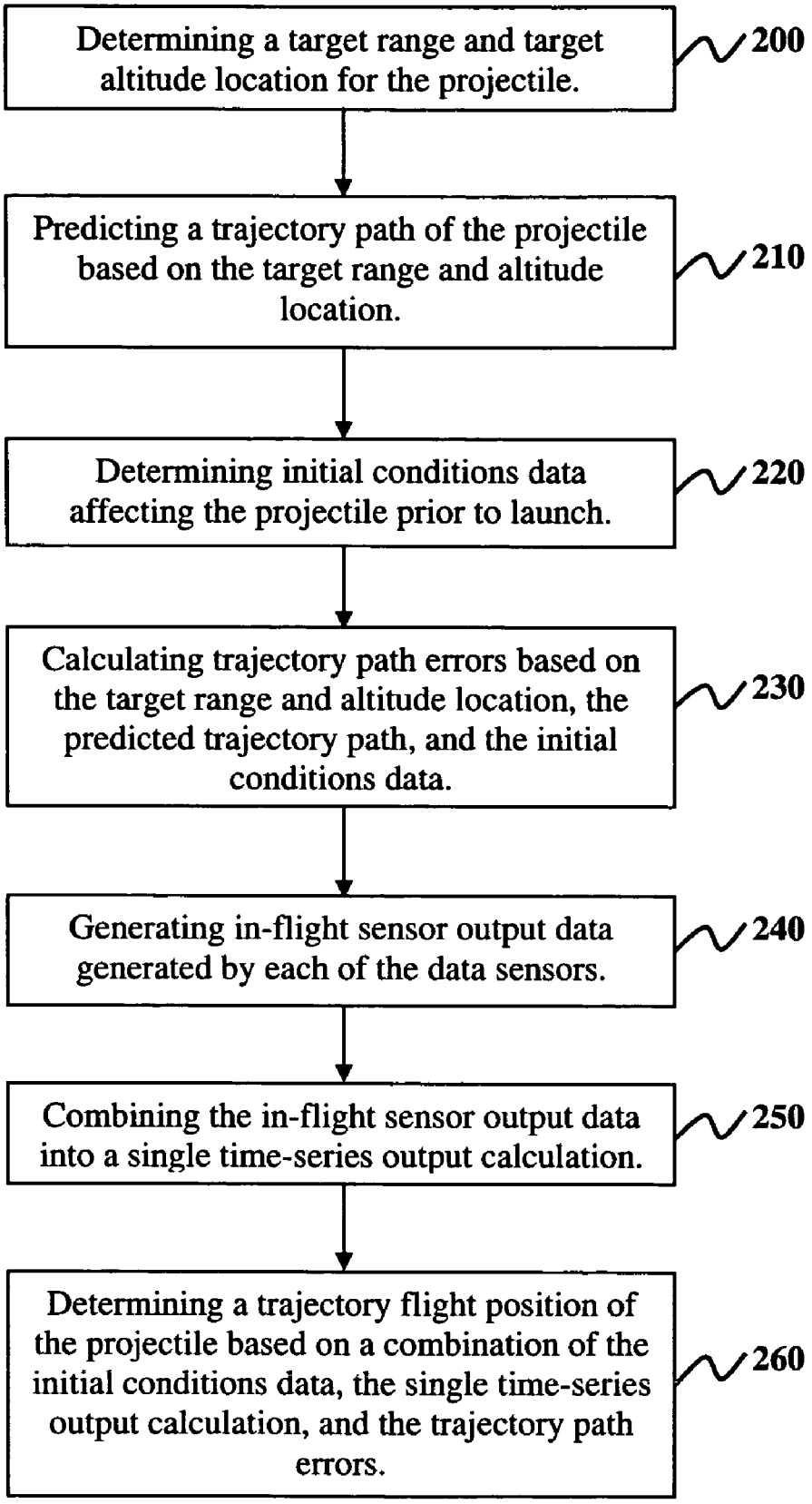

FIG. 1(*a*) illustrates a flow diagram for a method of data fusion, wherein the method comprises determining 100 pre-launch data affecting a flight of a self-sensing projectile, the projectile comprising a plurality of independent data sensors; predicting 110 a trajectory path of the projectile based on a target location of the projectile; calculating 120 trajectory path errors based on the predicted trajectory path; generating 130 in-flight data from each of the data sensors; combining 140 the in-flight data into a single time-series output; and tracking 150 a trajectory position of the projectile based on the single time-series output, pre-launch data, and the trajectory path errors. The method further comprises comparing 160 the tracked trajectory position with the predicted trajectory path; analyzing 170 the in-flight data to gauge successful navigation of the projectile to the target location; and self-guiding 180 the projectile to the target location based on the trajectory position.

The pre-launch data comprises range wind data, cross-wind data, temperature data, and pressure data. Moreover, the target location comprises a target range and a target altitude location. The step of combining 140 occurs in a fusion filter, which may comprise a computer processed algorithm for combining the outputs of the various different sensors. The data sensors comprise any of a timer operable for generating time data and corrected time data of the projectile, a turns counter operable for generating magnetic turns count data of the projectile, and an accelerometer operable for generating acceleration data of the projectile. Furthermore the pre-launch data, the target location, predicted trajectory path data, and trajectory path error data are transmitted to the projectile from a fire control computer remotely located from the projectile prior to launch. Additionally, the projectile comprises any of air bursting munitions, ballistic munitions, and unguided munitions. Also, the self-sensing projectiles comprise fuze-sensing projectiles. Moreover, the self-sensing projectiles comprise range sensing, altitude sensing, and a combination of both. The step of combining 140 in-flight data produces a collective prediction of the trajectory position as a function of time-from-launch, and the step of combining 140 in-flight data comprises a fusion of time-sampled outputs from an arbitrary suite of the data sensors, wherein the time-sampled outputs comprise a time-labeled, finite sequence of real numbers for a pre-determined set of unique time sample values.

Another embodiment of the invention illustrated in the flow diagram of FIG. 1(*b*) provides a method for tracking a trajectory position of a fuze-sensing projectile, wherein the method comprises determining 200 a target range and target altitude location for the projectile, wherein the projectile comprises a plurality of data sensors; predicting 210 a trajectory path of the projectile based on the target range and altitude location; determining 220 initial conditions data affecting the projectile prior to launch; calculating 230 trajectory path errors based on the target range and altitude location, the predicted trajectory path, and the initial conditions data; generating 240 in-flight sensor output data generated by each of the data sensors; combining 250 the in-flight sensor output data into a single time-series output calculation; and determining 260 a trajectory flight position of the projectile based on a combination of the initial conditions data, the single time-series output calculation, and the trajectory path errors.

According to the invention, for fuze-sensing, the output from multiple onboard sensors are fused, or integrated, into a single common prediction of the projectile's trajectory during flight, rather than separated as in conventional designs. In addition, all data collected by the fire control computer is preferably utilized in this common prediction as much as practical. A realistic analysis of this problem is preferably statistical in nature in the sense that output from the onboard sensors exhibits noise and perhaps bias during flight. The high-g stress levels encountered during launch can cause bias in some or all of the onboard sensors, even if such bias were absent prior to launch. This implies that the sensor/measurement model is generally stochastic. At the same time, however, the "process model" for predicting trajectories is stochastic as well. In this case, however, the stochastic nature of this "process" cannot be modeled simply as an additive white process noise, as is commonly done in signal processing.

As further discussed below, the essence of the fuze-sensing problem is the difference between the conventional computed nominal trajectory, which is based upon the nominal (baseline) estimated knowledge and the actual trajectory followed by the projectile, which is determined by the actual instance of the projectile's flight that occurred for that round. The components of a projectile's flight comprise all of the Met and pre-flight data required to uniquely and deterministically predict the trajectory of a specific round. The underlying reason for this difference between the projectile's estimated flight and the actual flight is statistical in nature. Given a particular gun system and its associated ammunition, there are gun-to-gun, lot-to-lot, and round-to-round (within lot) statistical variations. In the primary case of interest, that of a military combat scenario, there are additional occasion-to-occasion and round-to-round (within occasion) statistical variations as well[4]. In contrast, the sensor measurement noise occurs entirely within the flight of any given round. Some aspects of this noise, however, can vary from round-to-round.

Onboard ballistic navigation is viewed abstractly as a system with uncertain system parameter values, denoted by the random variable $\Gamma$, whose state evolution is to be determined by non-redundant (preferably multi-modal and orthogonal) sensor readings in the presence of sensor noise and bias. Estimation methodology hence would appear to be a promising approach to sensor fusion for this case. A straightforward application of sequential estimation theory to this problem, using an extended or "unscented" Kalman filter[5–8] or a particle filter[9] as possible examples, requires, inter alia, the online, real-time implementation of a trajectory simulation model. Conventional kinematic models[6] commonly used in tracking and navigation may be inadequate for modeling ballistic trajectories, at least when used in conjunction with the medium-caliber, passive sensor suites.

As previously indicated, the evolution of gun-rugged, onboard DSP/CPUs (digital signal processors/central processing units) for medium caliber munitions has been characterized by tremendous increases in computing power and decreases in unit cost and size. However, these onboard devices may be incapable of computing real-time solutions to such highly nonlinear ballistic trajectory models containing uncertain system parameter values. Any application of estimation methods to this problem must consider the constraint of limited online computational capability. As such, current DSP/CPU technology does allow for some online (onboard) computation and signal processing for medium caliber munitions, making sensor fusion according to the invention a feasible solution. Therefore, the invention offers a practical estimation approach to this problem by providing for a sharing of the total computations between the online DSP/CPU and the offline, more powerful fire control computer. The bulk of the computations are preferably performed on the offline computer prior to any online computations. Such an approach, which is provided by the invention, is only limited by the amount of information that can be passed from the fire control computer to the projectile during the dwell time between firings.

With sequential estimation methods currently precluded, batch estimation[10] methods logically appear to be a natural alternative. With few exceptions, traditional batch estimation methods, such as Maximum A Posteriori (MAP) estimation, Maximum Likelihood Estimation (MLE), Minimum Mean Square Error (MMSE) estimation, Least Squares (LS) estimation, and Weighted Least Squares (WLS) estimation [5–6] are a posteriori in their approach to the problem; wherein the bulk of the computations (optimization process) must be performed after the sensor output values have all been obtained. They are hence irrelevant as solutions to the above-identified problems except in the cases of either linear MMSE (LMMSE) or linear LS/WLS.

For these two exceptions, however, the difference between the "prior" and the current estimate for the state variables/parameters is the "filter gain" (or weighting) matrix (right) multiplied by the measurement residual vector. The "prior" state variable/parameter estimate, the associated measurement prediction, and the "filter gain" matrix can all be a priori computed offline, independent of the sensor measurements. These two methods are hence potentially adaptable as a priori batch estimation methods for which the bulk of the computations are performed offline, prior to any online computations, without knowledge of the sampled sensor output values. There are at least three problems with traditional linear LS/WLS estimation, however. First, the formulation of LS/WLS in terms of a "filter gain" (or weighting) matrix requires a linearization[10] of both the process and measurement models. As such, the use of linearized models is restrictive for this application. Second, an unbiased noise is assumed. Bias in the sensor output is an important factor however. In fact, the bias values are typically unknown prior to launch, so adjustments for them must be made during flight. Third, the flexibility in controlling the signal-to-noise ratio is limited to tuning the weight values in the WLS method. Therefore, these considerations leave LMMSE estimation as the most viable of the two traditional a priori batch estimation methods. Thus, the sensor fusion filter provided by the invention includes LMMSE as one of a complementary pair of methods that together constitute a complete solution to the trajectory estimation problem.

According to the mathematical models implemented by the invention, some parameters are first defined. Let the Met and aerodynamic/mechanical response data be collected together as the components of a column-vector denoted generically by the variable symbol $\Omega$ that is, the components of $\Omega$ consist of the intrinsic aerodynamic/mechanical response parameter values for the specific munition and the Met parameter values. Similarly, let the initial condition data be collected together as the components of a column-vector denoted generically by the variable symbol $\boldsymbol{u}$. The parameter values contained in $\Omega$ determine the coefficients for the differential equations governing the projectile's motion and also the data required to compute the aerodynamic forces and moments applied to the projectile during its flight. The initial condition data $\boldsymbol{u}$ determines a unique solution to the differential equations governing the projectile's flight. In a first [1] definition $\Gamma$ is defined by:

$$\Gamma = \left\{\frac{\Omega}{\boldsymbol{U}}\right\} \tag{1}$$

so that all of the (pre-flight and down-range) data required to uniquely determine the trajectory of a specific round within a given occasion form the components of the column-vector $\Gamma$. The trajectory is mathematically fully prescribed as the solution to a set of coupled, nonlinear first order ordinary differential equations and their initial conditions for the components of u(t), $t \geqq 0$. They are abstractly and generically denoted here by:

$$\frac{\partial u}{\partial t} = A(\Omega, u, t) \text{ for } t > 0 \tag{2}$$

$$u(0) = C(\boldsymbol{u}), \tag{3}$$

where A and C are known. By definition, each u(t) uniquely determines the canonical 6-dof (degrees of freedom) rigid body motion of the projectile as a function of time-from-gun-exit t, generically denoted by the six-component vector function:

$$g(\Gamma, t) = B(u), \tag{4}$$

where B is a known operator. The dependence of g upon $\Gamma$ is explicitly represented, wherein this dependence arises from the dependence of g upon the sub-vectors of $\Gamma$ given by $\Omega$ and $\boldsymbol{u}$. There is no input vector for equation (2) as active guidance control feedback has been precluded from the analysis.

If $\Gamma$ denotes the projectile's flight, then $\Gamma_0$* is the measured/estimated data used to compute the nominal trajectory. Moreover, a first [1] definition provides that if $\Theta$ is an operator such that:

$$\theta(\Gamma, t) = \Theta[g(\Gamma, t)] \tag{5}$$

is a real scalar-valued function $\theta$ which is bijective (one-to-one and onto) in its t dependence for $t \in [a, b]$, then $\theta$ is the gauge variable for $\Gamma$ for the interval $[\theta(\Gamma, a), \theta(\Gamma, b)]$ and $\Theta$ is the gauge extraction operator associated with the gauge variable $\theta$. A global gauge variable is one for which $\theta(\Gamma, t)$ is bijective for $t \in [0, b]$ for any $b < \infty$.

This definition for gauge variable implies that there is a $\mu(\Gamma, \theta)$ such that $\mu(\Gamma, \theta(\Gamma, t)) = t$ for $t \in [a, b]$. The progression of $g(\Gamma, \mu(\Gamma, \theta))$ along the trajectory can hence be "gauged" by the value of $\theta$ over the interval $[\theta(\Gamma, a), \theta(\Gamma, b)]$ as an alternative to being gauged by t over [a, b].

The sensor fusion problem for onboard ballistic navigation is a special case of the more general problem of sensor fusion subject to the constraint of limited online computational resources. In order to define the parameters of the invention mathematically, it will be useful to initially formulate the sensor fusion problem and its solution in general, generic terms. In order to do this, a sensor model definition is required in addition to equations (1) through (4).

A second [2] definition provides that: Associate with a particular choice of sensor suite a known sensor suite extraction operator $\Sigma$ which extracts the sensor measurements from g of equation (4). The $N_s$ components of:

$$s(\Gamma, t) = \Sigma[g(\Gamma, t')] + \mathcal{N}(t) \tag{6}$$

are the (possibly processed) real scalar output functions of time that a particular sensor suite would produce, where the stochastic process $\mathcal{N}(t)$ represents the sensor suite noise vector. One of the objectives of the sensor fusion solution of the invention is the online estimation of the function $\rho_\pi(\Gamma, t)$ sampled at the times $t \in T_{K_s} \subseteq D_\pi$ given the values of s sampled at the times $t \in I_{M_s}$. This desired information is extracted from g by some known, user-chosen extraction operator $\pi$ as:

$$\rho_\pi(\Gamma, t) = \pi[g(\Gamma, t')] \text{ for } t \in D_\pi, \tag{7}$$

where $\rho_\pi$ has $\ell$ real-valued, function-of-time components. The a priori user-chosen set $I_{M_s}$ generically denotes $M_s$ unique, finite real numbers (time values). Similarly, the a priori user-chosen set $T_{K_s}$ generically denotes $K_s$ unique, finite real numbers (time values).

In addition to the process and sensor models, the invention is based, in part, upon the following parameters: (1) If the value of $\Gamma$ is exactly known, then equations (1) through (4) are accurate; (2) Obtaining g from equations (1) through (4) given $\Gamma$, $\Sigma[g(\Gamma, t')]$ given g, or $\pi[g(\Gamma, t')]$ given g are each impractical online (onboard) computations. In contrast, they are each assumed to be readily computed offline; (3) a reasonable amount of offline computational results can be a priori communicated to the online computer, but no ongoing communication for t>0 is allowed. Quantification of what constitutes "reasonable" will depend upon the bandwidth available for the a priori offline/online communication, as well as other implementation-dependent parameters; (4) The sensor noise $\mathcal{N}$ is additive, as is indicated by equation (6); (5) A prior distribution is known for the random variable $\Gamma$ from which it can be sampled in the Monte Carlo sense; (6) A prior distribution is known for the stochastic process $\mathcal{N}$ from which it can be sampled (as functions of time) in the Monte Carlo sense; and (7) The Monte Carlo sampling of $\Gamma$ and $\mathcal{N}$ referred to above, respectively, are independent of one another.

The estimation computations of the invention ultimately take the form of an optimization process. In order to uncouple the optimization process of the invention's estimation method from the sensor output values so that the computations can be performed prior to the measurements, the space of possible sensor output vectors is decomposed into (the direct sum of) two subspaces. One subspace has an a priori known structure and comprises a discrete subset whose elements are estimated/filtered by the invention's method. These elements are, like the "particles" in a particle filter, obtained by a Monte Carlo draw, a process which is known in the art. The optimization process comprises of minimizing the component of the sensor output vector belonging to the other subspace by minimizing the corresponding projector operator itself.

Moreover, the sensor fusion filter provided by the invention comprises two complementary sub-methods: First, as one asymptotically approaches the real-time fire control computer capability limit of large numbers of Monte Carlo trajectory simulations, on the order of thousands or more, a priori batch LMMSE estimation is viable. Second, as one asymptotically approaches the real-time fire control computer capability limit of small numbers of Monte Carlo trajectory simulations, on the order of tens or less ($J_g$=35 for example), a priori batch Monte Carlo interpolation estimation provided by the invention should be used.

The following development is based upon the observation that interpolation in the appropriate function space ultimately allows for all of the sensor fusion filter computations that are impractical for the online computer to be performed a priori by the offline computer. The mathematical development of the filter is expedited by a few mathematical preliminary definitions and results.

According to the invention, the filter process is analogous to an "interpolation" in function space in the sense that the resulting filter exactly estimates the chosen interpolation "points" (functions). Moreover, the invention is somewhat analogous to the idea of using trial functions in a collocation weighted residual method[11,12] for which the trial functions interpolate the collocation points. The interpolation "points" are chosen by a Monte Carlo draw since the resulting points are concentrated more in those regions of the function space associated with a greater probability of actual occurrence. This leads to a more efficient interpolation for a given number of points. As these "points" are reminiscent of the "particles" in a sequential particle filter[9], the invention can also be loosely thought of as a "particle" interpolation filter. The approach provided by the invention has the advantage that the "prior" distributions assumed for $\Gamma$ and $\mathcal{N}$ do not have to be exact; they only have to be accurate enough to distribute the interpolation "points" efficiently. The following preliminary definitions aid in defining the set of interpolation "points".

A third [3] definition provides that: Let $\underline{\tau}$ be an independent and identically distributed (i.i.d.) Monte Carlo sample from the distribution for $\Gamma$ corresponding to each $j\epsilon\{1, \ldots J_g\}$. Similarly, let $\underline{\nu}$ be an independent and identically distributed (i.i.d.) Monte Carlo sample from the distribution for $\mathcal{N}$ corresponding to each $j\epsilon\{1, \ldots J_n\}$. Let $\Gamma_0$* denote the nominal trajectory. The value of:

$$J=J_g+J_n \tag{8}$$

must be chosen such that the constraint:

$$J+1\leqq N_s M_s \tag{9}$$

is satisfied, where $N_s$ and $M_s$ have been defined above. Let $g(\underline{\tau}, t)$ be the solution to equations (1) through (4) for $\Gamma_j$* for each $j\epsilon\{0, \ldots J_g\}$. Define:

$$\sigma=\{N_1 \ldots \underline{\nu}_j \ldots N_{J_n}\} \tag{10}$$

so that $\underline{\nu}_j$ is the jth column of $\sigma$. The set of sensor interpolation points is defined as:

$$S_1=\{s_j=\Sigma[g(\Gamma_j^*,t')]+\sigma b|b\epsilon\Re^{J_n\times 1} \text{ and } j\epsilon\{0, \ldots ,J_g\}\}, \tag{11}$$

where $\Re$ is the set of real numbers and $\Re^{J_n\times 1}$ denotes the set of all real (constant) $J_n\times 1$ matrices. The online estimate $\hat{\rho}_\pi$ for $\rho_\pi$, given the values of any $s_j\epsilon S_1$ sampled at the times $t\epsilon I_{M_s}$, is required to give the exact result:

$$\hat{\rho}_\pi=\pi[g(\Gamma_j^*,t')] \tag{12}$$

In comparison with equation (6), the $\sigma b$ term of equation (11) is seen to approximately model the sensor suite noise $\mathcal{N}$.

The sensor fusion filter as provided by the invention includes the construction of more complex operators from the composition of simple operators, so that the resulting mathematical structure is both concise and algebraic. The development hence continues with the preliminary description of the basic operation of time sampling, which is formally defined as an operator as follows.

A fourth [4] definition provides that: Let A generically denote an N×M matrix whose components are each real-valued functions with domain $D\subseteq\Re$, where $\Re$ is the set of real numbers. For a given finite set generically denoted by $\chi_K\subseteq D$ such that $\chi_K=\{\tau_1, \ldots \tau_j, \ldots \tau_K\}$ satisfies $\tau_1<\tau_2<\tau_j<\tau_K$, the time sampling operator $\Delta(\chi_K)$ is defined such that:

$$\Delta(\chi_K)[A(t)] = \begin{Bmatrix} A(\underline{\tau}) \\ \vdots \\ A(\tau_j) \\ \vdots \\ A(\underline{\tau}) \end{Bmatrix} \tag{13}$$

describes its operation upon A, the result being a KN×M constant matrix. The operator $D(\chi_K)$ is similarly defined as:

$$D(\chi_K)[A(t)] = \begin{Bmatrix} A(\xi_1) & 0 & \dots & 0 \\ 0 & A(\xi_2) & \dots & 0 \\ \vdots & \vdots & \ddots & \vdots \\ 0 & 0 & \dots & A(\xi_L) \end{Bmatrix}. \tag{14}$$

In equation (14) the diagonals of each of the (block-diagonal) submatrices $\mathcal{A}(\xi_i)$ coincides with the diagonal of the resulting global matrix only if N=M. Using the above definitions, it follows that:

$$\Delta(\chi_K)[\alpha A(t)]=\alpha\Delta(\chi_K)[A(t)] \tag{15}$$

$$\Delta(\chi_K)[A(t)+B(t)]=\Delta(\chi_K)[A(t)]+\Delta(\chi_K)[B(t)] \tag{16}$$

$$\Delta(\chi_K)[A(t)B(t)]=D(\chi_K)[A(t)]\Delta(\chi_K)[B(t)] \tag{17}$$

hold for any conforming matrices A and B, where a denotes an arbitrary constant scalar. As a useful special case, equation (17) reduces to $$\Delta(\chi_K)[A(t)B]=\Delta(\chi_K)[A(t)]B \tag{18}$$

whenever B is a constant matrix.

With the addition of a few more preliminary definitions, the following protocol establishes one of the principal results of the sensor fusion filter development according to the invention. Define:

$$G(E)=\{E[g(\xi_1,t')]\ldots E[g(\Gamma_j^*,t')]\ldots E[g(\Gamma^*_{J_g},t')]\} \tag{19}$$

so that $E[g(\delta_j^*, t')]$ is the jth column of G(E), where E is a generic extraction operator, an example being $E\rightarrow\pi$ for $\pi$ from equation (7). For $E\rightarrow\Sigma$ from equation (6) as the extraction operator in equation (19), define:

$$H(t)=\{G(\Sigma)\sigma\} \tag{20}$$

so that $G(\Sigma)$ and $\sigma$ from equation (10) are (block) submatrices of the matrix H(t), whose columns are functions of time. The matrix Q is defined by:

$$Q=\{I_{(J_g+1)}O_{(J_g+1)\times J_n}\} \tag{21}$$

where the I and O of equation (21) are the $(J_g+1)\times(J_g+1)$ identity and $(J_g+1)\times J_n$ zero submatrices of Q, respectively. The constant matrix A is defined as:

$$A=\Delta(I_{M_s})[H] \tag{22}$$

for $\Delta$ from Definition [4], $I_{M_s}$ from Definition [2], and H from equation (20). If equation (9) and:

$$\text{rank}[\Lambda]=J+1 \tag{23}$$

are satisfied, so that A is full rank and the set of left inverses of $\Lambda$ given by:

$$\mathcal{L}=\{\Lambda^L|\Lambda^L\Lambda=I_{J+1}\} \tag{24}$$

is not empty, then each estimate $\hat{\rho}_\pi$ for $\rho_\pi$ given by:

$$\hat{\rho}_\pi\epsilon\{\Psi(\pi)s_j|\Psi(\pi)\epsilon\nu(\pi) \text{ and } s_j\epsilon S_I\} \tag{25}$$

satisfies equation (12), where:

$$\nu(\pi)=\{G(\pi)Q\Lambda^L\Delta(I_{M_s})|\Lambda^L\epsilon\mathcal{L}\} \tag{26}$$

is the set of estimation operators and $S_I$ is defined by equation (11). Moreover, if $s_j\epsilon S_I$, then:

$$\begin{aligned} s_j &= \Sigma[g(\Gamma_j^*,t')] + \sigma b \\ &= G(\Sigma)e_j + \sigma b \\ &= H\begin{Bmatrix} e_j \\ b \end{Bmatrix} \end{aligned} \tag{27}$$

is true for some $j\epsilon\{0, \ldots, J_g\}$ and some $b\epsilon\Re^{\times 1}$, where the $(J_g+1)\times 1$ matrix $e_j$ is defined by:

$$e_j = \begin{cases} 1 \text{ for the } j\text{th row} \\ 0 \text{ otherwise.} \end{cases} \tag{28}$$

For each $\Psi(\pi)\epsilon\nu(\pi)$ $$\begin{aligned} \Psi(\pi)s_j &= G(\pi)Q\Lambda^L\Delta\left(I_{M_s}\left[H\begin{Bmatrix} e_j \\ b \end{Bmatrix}\right]\right) \\ &= G(\pi)Q\Lambda^L\Delta\left(I_{M_s}H\right)\begin{Bmatrix} e_j \\ b \end{Bmatrix} \\ &= G(\pi)Q\Lambda^L A\begin{Bmatrix} e_j \\ b \end{Bmatrix} \\ &= G(\pi)Q\begin{Bmatrix} e_j \\ b \end{Bmatrix} \\ &= G(\pi)e_j \\ &= \pi[g(\Gamma_j^*, t')] \end{aligned} \tag{29}$$

results from the use of equation (26) with equations (27), (18), (22), (24), (21), and (19) with (28), in the order given. Each $\hat{\rho}_\pi$ from equation (25) hence satisfies equation (12) by equation (29).

The above rules show that the interpolation "points" of the third [3] definition (i.e., Definition [3]) are exactly filtered. It is hence reasonable to assume that if $J_g$ and $J_n$ are each large enough to interpolate both the sensor signal and noise, respectively, to a sufficiently high degree, then the estimates $\hat{\rho}_\pi$ should accurately reflect the "interpolated part" of the sensor output s.

The question naturally arises as to whether there is a "non-interpolated part" of the sensor output s, which is inaccessible to the estimation process of the filter. These issues are formally investigated and quantified next. In answering the question as to which particular matrix of the set $\mathcal{L}$ should be used in the estimation process, it turns out that a natural choice is the one which minimizes, in some sense, the "non-interpolated part" of the sensor output s. The following equations establish the next principal result of the sensor fusion filter development according to the invention; that the sensor output s can be formally decomposed into an "interpolated part" and a "non-interpolated part". The rules provide a definition of the sets:

$$\mathcal{H}=\{Ha|a\epsilon\Re^{(J+1)\times 1}\} \tag{30}$$

$$\mathcal{V}=\{H\Lambda^L\Delta(I_{M_s})|\Lambda^L\epsilon\mathcal{L}\} \tag{31}$$

for H given by equation (20). For each $P=H\Lambda^L\Delta(\mathcal{L}_m)\in\gamma$ and corresponding estimation operator $\Psi(\pi)=G\pi Q\Lambda^L\Delta(I_{M_s})$, for the same $\Lambda^L$, $$P^2=P \tag{32}$$

$$Ps=s \text{ for every } s\in\mathcal{H} \tag{33}$$

$$\Delta(\mathcal{L}_m)P=\Lambda\Lambda^L\Delta\Delta(I_{M_s}) \tag{34}$$

$$\Psi(\pi)P=\Psi(\pi) \tag{35}$$

so that P is idempotent by equation (32). In addition, $$S_I\subseteq\mathcal{H} \tag{36}$$

for $S_I$ given by equation (11). This can be proved by considering equations (27) and (28), where:

$$a=\begin{Bmatrix} e_j \\ b \end{Bmatrix}$$

for the particular chosen j and b. For generic constant conforming B, $$\begin{aligned}\Delta(I_{M_s})[HB] &= \Delta(I_{M_s})[H]B \\ &= \Lambda B\end{aligned} \tag{37}$$

results from the use of equation (18) and then equation (22), and for each $P\in\gamma$ $$\begin{aligned}PHB &= H\Lambda^L\Lambda(I_{M_s})[HB] \\ &= H\Lambda^L\Lambda B \\ &= HB\end{aligned} \tag{38}$$

results from the use of equations (31), (37), and (24), in the order given. The case B=a in equation (38) proves equation (33) and the case $B=\Lambda^L\Lambda(I_{M_s})[HB]$ in equations (38) and (37) proves equations (32) and (34), respectively. Using equation (34) and then equation (24) in $\Psi(\pi)P=G(\pi)Q\Lambda^L\Delta(\mathcal{L}_m)P$ leads to $\Psi(\pi)P=G(\pi)Q\Lambda^L\Delta(\mathcal{L}_m$, and hence to equation (35). Each $P\in\gamma$ is a projector whose range $\mathcal{H}$ contains $S_I$, the interpolation "points". Any sensor suite output s can hence be uniquely decomposed as:

$$s=Ps+(I-P)s \tag{39}$$

for a given $P\in\gamma$. For the estimation operator $\Psi(\pi)$ previously described, equation (35) leads to $\Psi(\pi)(I-P)=0$, so that the information in the (I−P)s component of s does not contribute to the estimate $\hat{\rho}_\pi$. It is hence reasonable to interpret the Ps component of s as the "interpolated part" of s and the (I−P)s component of s as the "non-interpolated part" of s. As the information in (I−P)s is lost in the estimation process, it is desirable to minimize this component of s as much as possible.

As the bulk of the computations must be deferred to the offline computer, which will not have access to either s or its time sampled values, the minimization of (I−P)s is preferably carried out in a manner which is independent of s or its time sampled values $\Delta(I_{M_s})$ [s]. One can adopt the strategy of approximately minimizing (I−P)s by directly minimizing $\Delta(I_{M_s})[(I-P)s]$. The time sampled values of (I−P)s take the form:

$$\Delta(I_{M_s})[(I-P)s]=(I-\Lambda\Lambda^L)\Delta(I_{M_s})[s] \tag{40}$$

because of equation (34), so that minimizing $\Delta(I_{M_s})[(I-P)s]$ corresponds to minimizing $(I-\Lambda\Lambda^L)$ in some sense over the elements of $\mathcal{L}$ of equation (24). This can be done offline without reference to either s or $\Delta(I_{M_s})[s]$.

In the general case, a standard approach to minimization by way of an optimization process is to define a real-valued "cost function" for measuring the "size" of that which is to be minimized. According to the invention, if one has access to a strictly convex[14] function which satisfies a fifth [5] definition (i.e, Definition [5]) then the above rules indicate how such a cost function can be constructed from it for use in finding a unique $\Lambda^L$ which minimizes $(I-\Lambda\Lambda^L)$.

Definition [5] provides that: Let f: $\Re^{N_SM_S\times N_SM_S}\rightarrow\Re$, where $\Re$ is the set of real numbers, be a strictly convex function for which:

$$f(X^*)\leqq f(X) \text{ for all } X\in\Re^{N_SM_S\times N_SM_S} \tag{41}$$

with a priori known values of X* and f(X*). The property[14]

$$f(X)=f(X^*)\Rightarrow X=X^* \tag{42}$$

follows from the strictly convex property of f. According to the invention, Let $\mathcal{L}$: $\mathcal{F}\rightarrow\Re$ be defined by:

$$\mathcal{F}(\Lambda^L)=f(I_{N_SM_S}-\Lambda\Lambda^L+X^*)-f(X^*) \text{ for each } \Lambda^L\in\mathcal{L} \tag{43}$$

where f satisfies Definition [5], Λ is given by equation (22), and $\mathcal{L}$ is given by equation (24). Moreover, the functional $\mathcal{F}$ is strictly convex, it satisfies $\mathcal{F}>0$, and it attains $\mathcal{F}=0$ only when $(I-\Lambda\Lambda^L)=0$. Furthermore, the $(I-\Lambda\Lambda^L)=0$ condition can only be achieved for square, nonsingular Λ.

A sixth (6) definition (i.e., Definition [6]) provides that: For some given f satisfying Definition [5], let $\Lambda^\dagger\in\mathcal{L}$ denote the unique value for which:

$$\mathcal{F}(\Lambda^\dagger)\leqq\mathcal{F}(\Lambda^L) \text{ for all } \Lambda^L\in\mathcal{L} \tag{44}$$

where $\mathcal{F}$ has been previously defined above. Define:

$$\Psi^\dagger(\pi)=G(\pi)Q\Lambda^\dagger\Delta(I_{M_s}) \tag{45}$$

as that extraction operator $\Psi^\dagger(\pi)\in v(\pi)$ of equation (26) corresponding to $\Lambda^L\in\mathcal{L}$ The value $\Lambda^\dagger$ satisfying Definition [6] is the one that is to be used in the estimation process by way of $\Psi^\dagger(\pi)$.

With regard to the special case of least squares interpolation, as both an example and an important special case of possible f's satisfying Definition [5], the Frobenius matrix norm[15] denoted by $f(X)=\|X\|_F$ for a generic matrix X, has the usual norm property that X*=0 and f(X*)=0. The value $\Lambda^\dagger$ satisfying Definition [6] for this particular case[15] is that of the pseudo-inverse of Λ. It is best known for its use in least squares solutions. In particular, the least squares solution x to the problem Ax=y for n×m matrix A and n×1 matrix y with n≧m is given by $A^\dagger y$, where $A^\dagger$ is the pseudo-inverse of A. Similarly, the weighted least squares choice $f(X)=\|BX\|_F$ for some fixed, nonsingular matrix B allows one to "tune" the filter by a priori adjusting the values of the components of B to be used in the filter so as to minimize the signal-to-noise ratio appropriate to the application.

Essentially, the above-generated offline computations and online input provides the mathematical means of meeting one of the goals of the filter, according to the invention, which is the online estimation of the $\ell K_S$ values of $\Delta T_{K_s}[\rho_\pi]$ given the $M_S N_S$ values of $\Delta(I_{M_s})[s]$ for the known time sample values of $T_{K_s}$ and $I_{M_s}$. The estimation of the values for $\Delta T_{K_s}[\rho_\pi]$ can be found by application of $\Delta T_{K_s}$ to $\hat{\rho}_\pi = \Psi^\dagger(\pi)s$ for the estimation operator $\Psi^\dagger(\pi)$ from equation (45). This results in:

$$\begin{aligned}\Delta(T_{K_s})[\hat{\rho}_\pi] &= \Delta(T_{K_s})[\Psi^\dagger(\pi)s] \\ &= \Delta(T_{K_s})[G(\pi)Q\Lambda^\dagger\Delta(I_{M_s})[s]] \\ &= \Delta(T_{K_s})[G(\pi)]Q\Lambda^\dagger\Delta(I_{M_s})[s]\end{aligned}$$

upon use of equation (18). The estimate $\Delta(T_{K_s})[\hat{\rho}_\pi]$ can hence be directly related to the sensor output values $\Delta(I_{M_s})[s]$ by:

$$\Delta(T_{K_s})[\hat{\rho}_\pi] = \Phi(\pi)\Delta(I_{M_s})[s] \tag{46}$$

upon defining the constant $\ell K_S \times M_S N_S$ matrix $$\Phi(\pi) = \Delta(T_{K_s})[G(\pi)]Q\Lambda^\dagger \tag{47}$$

With a priori knowledge of $\Phi(\pi)$, $I_{M_s}$, and $T_{K_s}$ from the offline computer, the online computer can hence sample the $N_S$ sensor suite output values at each of the $I_{M_s}$ time values, and matrix multiply these by $\Phi(\pi)$ as in equation (46) so as to obtain the discrete relation for $\hat{\rho}_\pi$ given by the components of $\Delta(T_{K_s})[\hat{\rho}_\pi]$ versus the components of $T_{K_s}$.

As far as the needs of the online computer are concerned, the main task of the offline computer is to compute the matrix $\Phi(\pi)$. A summary of the steps for this computation is as follows:

1. Start with the following as given: $I_{M_s}$ and $T_{K_s}$ (and hence $M_S$ and $K_S$), the nominal trajectory $\Gamma_0^*$ from Definition [3], $\Sigma$ and $N_S$ for the sensor suite from Definition [2], deterministic equations (1) through (4) for $g(\Gamma, t)$ given a value of $\Gamma$, $J_g$ and $J_n$ from Definition [3] satisfying equations (8) and (9), the target extraction operator $\pi$ from equation (7), an f satisfying Definition [5], and "prior" distributions for $\Gamma$ of equation (1) and $\Lambda$ of equation (6)

2. Obtain i.i.d. Monte Carlo samples $\Gamma_j^*$ for $j \in \{1, \ldots J_g\}$ and $\Lambda_j$ for $j \in \{1, \ldots J_n\}$ as in Definition [3].

3. Form $\sigma$ according to equation (10) of Definition [3].

4. Solve equations (1) through (4) for $g(\Gamma_j^*, t)$ for each $j \in \{0, \ldots J_g\}$.

5. Apply $\Sigma$ to $g(\Gamma_j^*, t)$ for each $j \in \{0, \ldots J_g\}$, as in $G(\Sigma)$ from $E \rightarrow \Sigma$ in equation (19). Sample the results, along with $\sigma$ of step 3, at the time values of $I_{M_s}$ according to equations (20) and (22) so as to obtain $\Lambda$. The computed $\Lambda$ preferably conforms to equation (23).

6. Apply $\pi$ to $g(\Gamma_j^*, t)$ for each $j \in \{0, \ldots J_g\}$, as in $G(\pi)$ from $E \rightarrow \pi$ in equation (19). Sample the results at the time values of $T_{K_s}$ so as to obtain the matrix $\Delta(T_{K_s})[G(\pi)]$.

7. Solve for $\Lambda^\dagger$ as prescribed in Definition [6], so that equation (44) is satisfied, for the $\Lambda$ computed in step 5.

8. Compute $\Phi(\pi)$ by equation (47) using $\Lambda^\dagger$ from step 7 and $\Delta(T_{K_s})[G(\pi)]$ from step 6, noting that $Q\Lambda^\dagger$ is the matrix comprising of the first $J_g+1$ rows of $\Lambda^\dagger$. This value for $\Phi(\pi)$, along with $I_{M_s}$ and $T_{K_s}$, are passed on to the online computer.

As mentioned, the above iterations of rules, properties, and parameters serve to provide the mathematical expressions of implementing a sensor fusion filter according to the invention. Next, the sensor fusion filter is applied to the concept of fuze-sensing according to an embodiment of the invention. Moreover, according to the invention, fuze-sensing comprises gauge variable sensing. Additionally, the fuze-sensing approach provided by the invention may be extended to further specializations such as range sensing, altitude sensing, or any other type of fuze-sensing.

Essentially, a preferred solution is to apply the sensor fusion filter of the invention to solve the gauge variable measurement problem previously identified. The online application of Monte Carlo interpolation to the gauge variable sensing problem can be summarized as follows, wherein the Monte Carlo interpolation technique according to the invention is the preferred technique: Let $\Theta_{lethal}$ denote the extraction operator for $\theta_{lethal}$ as defined by equation (5) in Definition [1]. Take:

$$\ell \rightarrow 1$$

$$\rho_\pi \rightarrow \theta_{lethal}$$

$$\pi \rightarrow \Theta_{lethal}$$

so that $\theta_{lethal}$ is to be estimated by the filter. The online computer onboard the projectile then computes the time-to-target $t_{target}$ using the following method:

1. Obtain the pre-computed values for $\Phi(\Theta_{lethal})$, $I_{M_s}$, $T_{K_s}$, and $[\theta_{lethal}]_{target}$ from the fire control computer prior to firing.

2. Sample the $N_S$ sensor suite output values at each of the $I_{M_s}$ time values so as to obtain $\Delta(I_{M_s})[s]$.

3. Matrix multiply the values obtained in step 2 by $\Phi(\Theta_{lethal})$ so as to obtain $\Delta(T_{K_s})[\hat{\theta}_{lethal}] = \Phi(\Theta_{lethal})\Delta(I_{M_s})[s]$, where $\hat{\theta}_{lethal}$ is the estimate for $\theta_{lethal}$.

4. Compute a spline fit $\phi$ using the values from step 3 such that:

$$\phi[\hat{\theta}_{lethal}(\tau_j)] = \tau_j \text{ for each } \tau_j \in \Delta(T_{K_s}) \tag{48}$$

are exactly interpolated, where the value $\hat{\theta}_{lethal}(\tau_j) \in \Delta(T_{K_s})[\theta_{lethal}]$ corresponds to $\tau_j \in \Delta(T_{K_s})$.

5. Evaluate the spline from step 4 to obtain $t_{target} = \phi[\theta_{lethal}]_{target}$.

The projectile is set to detonate when the condition $t = t_{target}$ has been attained during flight.

The above method may be extended to the case of an arbitrary $[\theta_{sensor}]_{target}$ instead of $t_{target}$, but there are several reasons for not doing so. In the first place, a timer is readily available for all but the smallest caliber munitions. Another advantage is that a "corrected timing" version of the above method is available for the case where muzzle exit velocity magnitude is directly measured for each round. In this case, the correction of the "corrected timing" method previously described is applied to $t^* = t_{target}$, where $t_{target}$ is computed by the steps listed above.

Engineering considerations for the gun system under consideration constrain at least some of the parameter values required by the offline method summarized above. This applies in particular to the values of $I_{M_s}$ and $T_{K_s}$, $J_g$ and $J_n$ from Definition [3], and $N_S$ from Definition [2]. The most severe of the constraints on these values is that associated with the fire-control/projectile communication bandwidth, but the projectile's processor speed, its memory capacity, and the sensor suite design influence these offline parameter values as well. In order to quantify these constraints, one must first estimate the amount of information that is to be a priori communicated to the projectile in step 1 of the online method as $\ell = 1$ in this case, the total information required by $\Phi(\Theta_{lethal})$ is $K_S M_S N_S$ numbers. In general, the sets $I_{M_s}$ and $T_{K_s}$ would require $M_S$ and $K_S$ numbers, respectively. Usually, however, each of these sets comprises a regular sequence of numbers that can be easily reconstructed from just a few parameter values. In this case, the amount of information required to represent the sets $I_{M_s}$ and $T_{K_s}$ would be considerably less than $M_S+K_S$ numbers. Let:

$$t_{min}=\min[I_{M_s}] \tag{49}$$

$$t_{max}=\max[I_{M_s}] \tag{50}$$

$$\tau_{min}=\min[T_{K_s}] \tag{51}$$

$$\tau_{max}=\max[T_{K_s}]. \tag{52}$$

The set $I_{M_s}$ is completely determined by the parameters $M_S$, $t_{min}$, and $t_{max}$, and $b_t$ if its elements $t_j$ obey the recursion:

$$t_{j+1}-t_j=b_t^{j-1}\delta_t, \tag{53}$$

where $b_t$ is known as the "bias" parameter[16] in finite element meshing, which is not analogous to sensor bias, and where $\delta_t$ is determined by:

$$\frac{(t_{\max}-t_{\min})}{\delta_t}=\frac{b_t^{M_S-1}-1}{b_t-1}. \tag{54}$$

The right hand side of equation (54) approaches $M_S-1$ (by l'Hôpital's rule) as $b_t\rightarrow 1$, corresponding to the case for which the time values $t_j$ are evenly distributed in equation (53). Similarly, the set $T_{K_s}$ is determined by the parameters $K_S$, $\tau_{min}$, $\tau_{max}$, and $b_\tau$ if its elements $\tau_j$ obey an analogous recursion. The values $t_j\epsilon I_{M_s}$ can be distributed more densely (skewed) towards either $t_{min}$ or $t_{max}$ depending upon the value of $b_t$, and similarly for the values $\tau_j\epsilon T_{K_s}$. Assuming that the $t_j\epsilon I_{M_s}$ satisfy equation (53) and similarly for $T_{K_s}$, then each set is completely determined by only four numbers. In this case, the parameters $b_t$ and $b_\tau$ can be thought of as "tunable" values for the filter, that is, their values can be a priori adjusted so as to enhance the performance of the filter. This data compaction for $I_{M_s}$ and $T_{K_s}$ does, however, place the additional burden on the projectile's processor of reconstructing both time sample sets, wherein the set $I_{M_s}$ is required before any time sampling of the onboard sensors can occur. If this additional burden is tolerable, then only $K_SM_SN_S+9$ numbers are needed for the online process to operate, including the value of $[\theta_{lethal}]_{target}$. Given the value $\nu$ for the minimum required bytes/number, the minimum amount of data to be transferred to the projectile is hence $\nu(K_SM_SN_S+9+h)$ bytes, where h is whatever additional miscellaneous "overhead" or calibration information that the fuze may require.

As $J_g$ and $J_n$ represent the number of interpolation "points" for the sensor signal and noise, respectively, one would expect that larger values of $J_g$ and $J_n$ should translate into more accurate and robust filter performance. The fire-control/projectile communication bandwidth limits their practical maximum attainable values, however, as quantified by the following factors:

1. The value of $N_S$ is fixed by the choice of sensor suite.

2. Signal-to-noise requirements typically constrain the number of time samples $M_S$ in $I_{M_s}$ to values well above the mathematically possible minimum indicated by equation (9). With $N_S$ fixed for a given sensor suite, a realistic relation between $M_S$ and $J=J_g+J_n$ is:

$$M_SN_S=\kappa(J+1) \tag{55}$$

where $\kappa>1$ is a factor with typical values of 1.5, 2 or 3, wherein a value of $\kappa=2$ is used in obtaining the results achieved by the invention.

3. As the values of $T_{K_s}$ are used in the in-flight construction of the spline $\phi$ for step 4 of the online method, one must choose $K_S$ to be just large enough for $\phi$ to accurately compute the time-to-target (time-of-burst) target, and no larger. An assumed value of $K_S=9$ is used in obtaining the results achieved by the invention. Moreover, in the case of altitude sensing, all of the time values of $T_{K_s}$ should be greater than or equal to the time of maximum altitude in order for the spline $\phi$ to produce unique time values for each altitude.

4. The pre-fire information-transfer-rate capacity and the projectile dwell time of the given gun system together determine the maximum amount of information W (bytes) that can be transferred to the projectile for that system. Taking maximum advantage of the available capacity leads to:

$$\nu(K_SM_SN_S+9+h)=W. \tag{56}$$

This constraint is particularly severe for systems with a high firing rate and hence small dwell time. Equation (56) limits the size of $M_S$ and also the size of $J=J_g+J_n$ by equation (55). The values $J_g=35$ and $J_n=0$ are used in obtaining the results achieved by the invention.

5. Another constraint:

$$\nu(K_SM_SN_S+9+h+K_S+M_S(N_S+1)+\mathcal{O})\leqq\mathcal{M} \tag{57}$$

arises from the memory capacity $\mathcal{M}$(bytes) of the projectile. Equation (57) represents the storage of $\nu(K_SM_SN_S+9+h)$ bytes from the fire control computer, $\nu(K_S+M_S)$ bytes for the reconstruction of the values of the sets $I_{M_s}$ and $T_{K_s}$, $\nu M_SN_S$ bytes for storing the time-sampled sensor output values, and $\nu\mathcal{O}$ additional bytes required as "overhead" in the matrix multiplication, spline construction and evaluation, etc. of the online method. Using a value of $\nu=4$ and $J=J_g=35$ leads to a value of W=2.6 kB (kilobytes) for the results achieved by the invention.

In addition to the above factors, which influence $M_S$, $K_S$, $J_g$, and $J_n$, the values of $t_{min}$, $t_{max}$, $\tau_{min}$, and $\tau_{max}$ are not freely determined either.

6. The value of $t_{min}\geqq 0$ should allow for the possible online reconstruction of the sensor time sample values for the set $I_{M_s}$ before sensor-output time sampling can commence. Also, it preferably allows for the possible post-gun-exit "powering up" of certain onboard electronics and possibly for the projectile's processor to "wake up". The accumulation of certain sensor signals such as timing and turns counting should function accurately at least upon exiting the gun. This is true even if their accumulated values are only being sampled at later times.

7. Let $\delta t_{obc}$ denote the post-sensor-sampling computation time required by the projectile's processor to compute the time-to-target (time-of-burst) value $t_{target}$ using the online method previously described. The value for $t_{obc}$ can be pre-flight-estimated, for example, by dividing an estimated floating-point-operation (flop) count for the all of the computations involved by the projectile's processor speed in terms of its effective flop rate $\zeta$. It is desirable to make:

$$\delta t_{obc}\propto\frac{1}{\zeta} \tag{58}$$

as small as possible, but this is controlled by the size of $\zeta$. A modest value of $\zeta$=0.326 Mflops/s is assumed in obtaining the results achieved by the invention.

8. A relevant implementation issue is that of terminating the computation of $g(\underline{r}, t)$ for each $j\epsilon\{0, \ldots J_g\}$ in step 4 of the offline method previously described above. The invention sets the trajectory simulation termination by way of a common maximum range value (given a common target range value), allowing the altitude to become negative if need be. The maximum range value preferably should exceed the target range value by a conservative amount, such as four times the anticipated standard deviation for the range error.

9. Predict the time-of-flight from $g(\underline{r}, t)$ for each $j\epsilon\{0, \ldots J_g\}$ and denote the largest time-of-flight value by $t_{mtof}$. Let $\gamma=1+\epsilon$ denote a "safety factor" for some small value of $\epsilon\geqq 0$. Take $\tau_{max}=\gamma t_{mtof}$. Extrapolate the flight paths of all of the $g(\underline{r}, t)$, $j\epsilon\{0, \ldots J_g\}$, out to $t=\tau_{max}$ value of $\gamma$=1.1 is used in obtaining the results achieved by the invention.

10. Predict the time-to-target for each of the $g(\underline{r}, t)$, $j\epsilon\{0, \ldots J_g\}$, and denote the smallest time-to-target value by $t_{mtob}$. If altitude is being sensed, predict the time-to-maximum-altitude for each of the $g(\underline{r}, t)$, $j\epsilon\{0, \ldots J_g\}$, and denote the largest of these values by $t_{malt}$. Let $\eta=1-\epsilon^*$ denote a "safety factor" for some small value of $\epsilon\geqq 0$. Take $\tau_{min}=\eta t_{mtob}$ if range sensing. For altitude sensing, take $\tau_{min}=\eta t_{mtob}$ if $\eta t_{mtob}>t_{malt}$, otherwise take $\tau_{min}=t_{malt}$. Next, take $t_{max}=\tau_{min}-\delta t_{obc}$, and check that $t_{max}>t_{min}$. A value of $\eta$=0.98 is used in obtaining the results achieved by the invention.

Alternative prescriptions, which can be easily ascertained by those skilled in the art, for determining the methodology parameter values may be used. However, one of the goals of the above prescription for the pre-flight-computed extreme values of $I_{\mathcal{M}_s}$ and $T_{K_s}$ are that the vital conditions $t_{max}+\delta t_{obc}<t_{target}$ and $\tau_{max}\geqq t_{target}\geqq\tau_{min}$ be conservatively met. This is an engineering design judgment, but clearly the projectile must know $t_{target}$ and be in a position to generate a fire signal before the actual in-flight attainment of $t_{target}$, and the $t_{target}$ value is preferably within the bounds $\tau_{max}\geqq t_{target}\geqq\tau_{min}$ order for $t_{target}$ to be accurately obtained in the first place. Generally, the gun system values of W, $\mathcal{M}$, and $\zeta$, along with the sensor suite design, directly determine the particular implementation of the filter methodology and hence its performance.

Software used to generate the simulation results achieved by the invention comprises the sensor fusion methodology provided herein. The simulations conducted in connection with the experimental testing of the invention and the resulting comparisons to conventional sensing methods uses $J_n$=0 in Definition [3], so that $H(t)=G(\Sigma)$ in equation (20). This means that much of the potential "filtering" action of the invention's method is disabled in the reported simulation results. This is compensated for by the use of noiseless sensor signals in the simulations. However, to be fair in their comparison, noiseless sensor signals are used as input to all of the competing conventional range sensing (and altitude sensing) methods. Because the special case $J_n$=0 minimizes W for a fixed $J_g$ by equations (8), (55), and (56), one can view the $J_n$=0 results presented here as that corresponding to the case of minimal information transfer to the projectile. This, in turn, corresponds to minimal methodology performance (in the presence of noise) as well.

Because the fuze cannot control the trajectory, the output of all of the range (and altitude) sensing methods is a single fire point. The sensor fusion filter methodology provided by the invention is capable of estimating the entire trajectory in-flight, so either range or altitude (or both) can be estimated. In the direct-fire simulations, the invention is set to estimate range, and the error in the range estimate is plotted versus the target range. For the indirect-fire cases, the methodology is set to estimate altitude, and the error in the altitude (or height-of-burst (HOB)) estimate is plotted versus the target range. For comparison purposes, the range errors for the most common conventional range sensing methods are also plotted for the range sensing cases. Similarly, the altitude errors for the simple method of timing are also plotted, as a benchmark, in the altitude sensing cases. It should be recalled that the actual target, perhaps a prone soldier, is at the ground altitude of 0. The term "target altitude" refers to the targeted burst altitude.

It is assumed that the fire control computer computes an optimum burst point based upon various measured values, such as slant range to target, the optimum (up-range) setback value and burst height relative to the ground target, the measured target elevation, etc. This optimum burst point is assumed to be the actual point at which an air burst is desired. If any corrections for wind, drift, etc. are to be made they are assumed to occur in the nominal trajectory's initial conditions at the time that the proper quadrant elevation and gun azimuth are computed (firing table) for the given target range. It is further assumed that the computed optimal burst point, expressed in terms of target range and target altitude (relative to the gun), is the target data passed on to the sensor fusion filter methodology provided by the invention. The nominal trajectory is, by definition, taken to pass through the optimum burst point.

It is important to distinguish between slant range, for example, which is the distance along a straight line from the gun to the target, and range. The orthogonal projection of the vector pointing from the gun to the target (optimum burst point) onto the plane, which is tangent to the earth at the gun location, establishes the direction of the positive range axis in earth-fixed coordinates, where the origin is at the gun location. Denote this as the x-axis. The tangent plane is an idealized one that ignores local surface irregularities such as hills; one could pragmatically define it as the plane whose points local to the gun are at the same gravitational potential as that of the gun. The component of the projectile's location vector along the x-axis at any given time is its range. The component of the optimum burst point (as a vector) along this axis is the target range. The positive z-axis is along the normal to the tangent plane and is pointing away from the earth's center, where the origin is at the gun location. The component of the projectile's location vector along the z-axis at any given time is its altitude relative to the gun. The right-hand-rule then establishes the y-axis, that is, the cross product of a unit vector along the +x-axis with a unit vector along the +y-axis yields a unit vector along the +z-axis. The component of the projectile's location vector along the y-axis at any given time is its deflection relative to the gun. The component of the optimum burst point (as a vector) along the z-axis is the target altitude. For trajectory cases for which the earth's curvature is significant along the flight path, a longitude-latitude-altitude coordinate system maybe preferable, but this is not the usual case for direct fire.

The results presented herein arise from an underlying output format which is fundamentally based upon a Monte Carlo simulation of a set of (4-dof MPM) trajectories for each chosen value of target range, the target altitude being held fixed at some user-determined value. Each Monte Carlo simulation set (MCSS) is generated by a "call" to a PRO- DAS (ballistic trajectory simulation) module[4], which takes the role of a "super subroutine". Each MCSS consists of the output of the simulation of x occasions with y rounds per occasion for a total of xy+1 trajectory data outputs (written to an ASCII text file) in each set, the values of x and y being user-chosen. The first trajectory, for round 0 of occasion 0, is always the nominal trajectory for that target range value. The other trajectories follow as "occasion 1, round 1", etc. The target range values increment by $z$, starting with a target range of $z$ and ending with a maximum value of Z, an MCSS file being generated for each value. The values of $z$ and Z are also user-chosen. For each target range value, the associated MCSS file is used to compute a standard deviation range error (or altitude error) for each particular range sensing (or altitude sensing) method being evaluated. Thereafter, standard deviation errors are generated from the corresponding MCSS files by parsing the MCSS file generated by the custom PRODAS module for each target range value.

For a given range sensing method, a subset of each MCSS file generated is composed of an output for trajectories that experience premature impact with the ground. The impacts are premature in the sense that they occur before the fuze has a chance to detonate "normally" according to the particular range sensing method. Ground impacts are not a range error source in the same sense as muzzle velocity or range wind error sources, but their effect on the standard deviation range error for the invention's sensor fusion method can be much larger than that of any of the "genuine" error sources or their combination. Their effect on conventional range sensing methods is also significant. There is a trade off between reducing premature ground impacts and increasing average burst height by increasing the target altitude, but this is not only munition-specific, but probably also target-specific. For the current simulations, it is assumed that as no range sensing method can prevent such impacts without guidance control capability, a fair comparison of such methods should be on the basis of excluding premature ground impacts. This being the case, the simulations and associated software distinguish "premature-ground-impact" trajectories from those that are "normal", rendering them potentially capable of providing statistics on each category separately as well as in combination.

The procedure followed by the simulation code is summarized as follows for a given target range value. For each range-sensing method being evaluated, the "ignore-the-ground" burst point (bp) bp=(r, d, a) and the "ignore-the-fuze" ground impact point (gip) gip=($r_i$, $d_i$, $a_i$) are both computed for each trajectory in the MCSS file associated with the given target range value, where r, d, and a represent range, deflection, and altitude, respectively. Incidentally, the $r_i$, of gip is set to infinity if the trajectory never impacts the ground for the entire flight history. For those trajectories for which $r>r_i$, the burst point is replaced according to bp→gip while "tagging" each such trajectory for which this replacement was required. For each final computed burst point bp, the square of the difference between the burst point range, altitude, and deflection and the target range, target altitude, and $d_{targetnorm}$, respectively, are computed, where $d_{targetnorm}$ is the deflection value for the nominal trajectory at the target range. No pre-fire burst point deflection corrections are made in the simulations. These values are additively accumulated over all of the trajectories in the MCSS file, each sum is divided by the number of trajectories, and the square root of each result is taken to produce a "one sigma" (standard deviation) range error, altitude error, and deflection error for that particular target range value. Given the "tagged" information, the percentage of premature ground impacts that occurred is also computed. The "one sigma" range, altitude, and deflection errors are separately accumulated and computed for that MCSS file for (1) the case (three values) where premature ground impacts are excluded; and (2) the case (three values) where premature ground impacts are included.

For each MCSS (i.e., Monte Carlo simulation set) file, the final output is a set of six "one sigma" error values, and a percentage-of-premature-impacts value, for each range-sensing methodology. The accumulation of this output data over each and every target range value can be manipulated and sorted thereafter. A subset of this sorted data is used to produce each of the plots (FIGS. 2 through 8).

The three particular munitions studied are the 30 mm 789 (deployed) and two 40 mm prototypes, referred to as "concept 12" and "concept 2SW". In all cases a "standard met" (i.e., standard meteorological) is assumed for the environment. A nominal muzzle exit velocity value of 1044 m/s is used for both of the 40 mm cases, whereas a value of 805 m/s is used for the 30 mm 789 case. The PRODAS input file also contains the "one sigma" (one-standard-deviation) values for each of the trajectory sources of error (perturbations from the nominal trajectory). These represent the sources of range error for the case of range sensing. The default values taken from two separate sources, A and B, for these "one sigma" values provided by the PRODAS software are shown in Tables 1 through 4 and can be changed by the user. These error source random variables are taken[19] as independent and Gaussian with the nominal trajectory values as the mode (most likely realization) of each variable.

TABLE 1

Occasion-to-Occasion "One-Sigma" Error Source Values A

| Gun elevation | Gun Azimuth | Gun Twist | Target Range | Muzzle Velocity | Ammunition Temperature |
|---|---|---|---|---|---|
| 0.5 mils | 0.5 mils | 1.0% | 0.5% | 2.5 m/s lot-to-lot | 5.0° C. |

TABLE 2

Occasion-to-Occasion "One-Sigma" Error Source Values B

| Velocity Slope | Drag/ Mass | Lift | Thrust | Air Temperature | Air Pressure | Wind (range & cross) |
|---|---|---|---|---|---|---|
| 0.25 m/s/° C. | 0.5% | 0.2% | 0.5% | 0.96% | 0.60% | 2.20 m/s |
| | Lot-to-lot | | | 1/2 hour stale Met | 1/2 hour stale Met | 1/2 hour stale Met |

TABLE 3

Round-to-Round "One-Sigma" Error Source Values A

| Gun Dyn. Elevation | Gun Dyn. Azimuth | Prj. Jump Elevation | Prj. Jump Azimuth | Muzzle Velocity | Drag/ Mass | Lift |
|---|---|---|---|---|---|---|
| 0.6 mils gun dynamics | 0.6 mils | 0.5 mils proj. disp. (TID) | 0.5 mils | 3.0 m/s round-to-round | 0.5% round-to-round | 0.5% |

TABLE 4

Round-to-Round "One-Sigma" Error Source Values B

| Spin Decay | Thrust | Range Wind | Cross Wind | Time Set | Turns Set | Acceleration Set |
|---|---|---|---|---|---|---|
| 0.20% | 0.5% | 0.5 m/s | 0.5 m/s | 0.1% | 0.1% | 0.1% |

Figure 2:
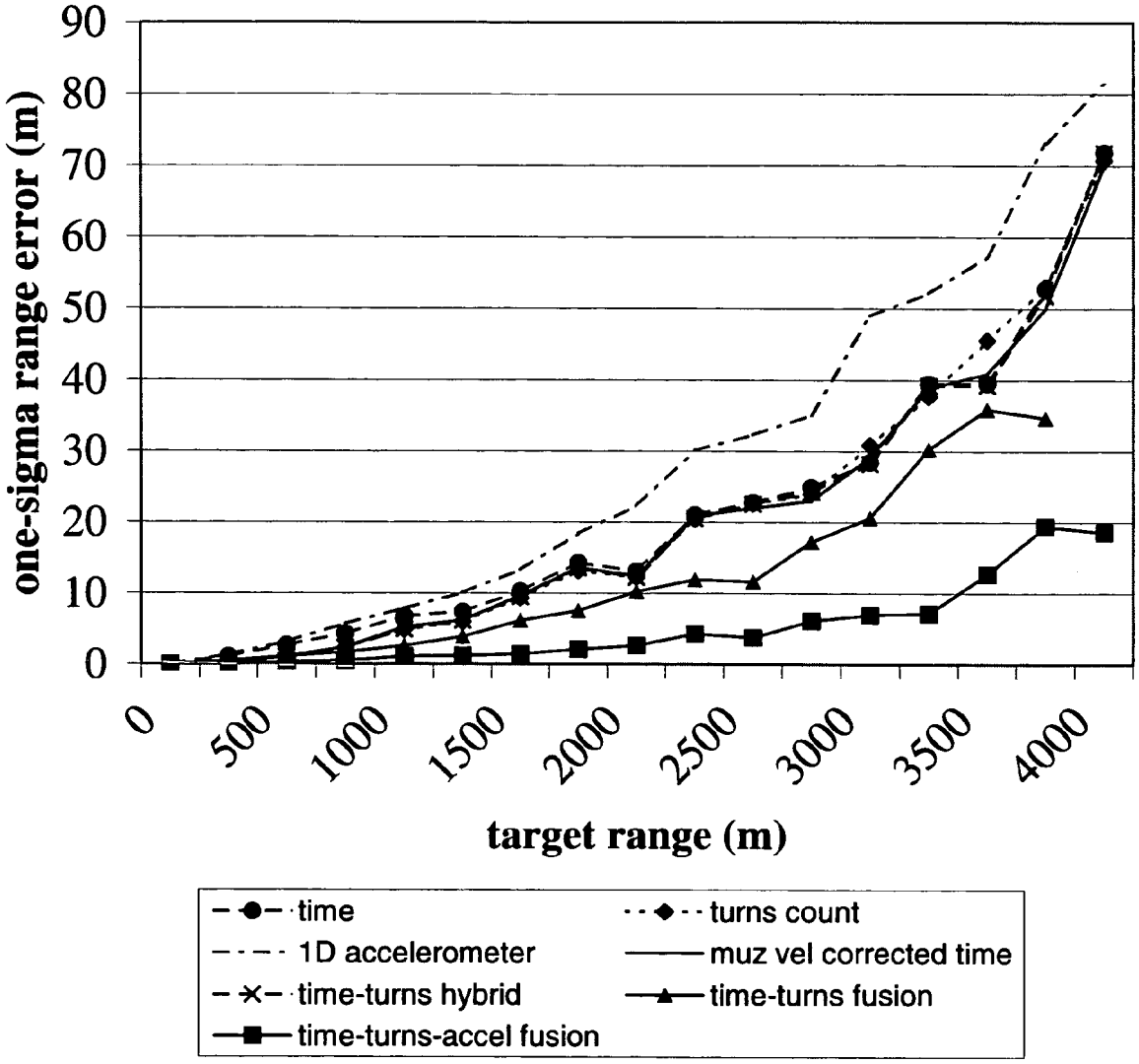
FIG. 2 is a graphical illustration of experimental results achieved according to an embodiment of the invention.

For the range sensing results the target range values are given in 250 m increments out to a maximum value of 4000 m, a Monte Carlo simulation of 50 occasions with 10 rounds per occasion (for a total of 501 trajectories, including the nominal) being generated for each value. In all cases the target altitude is set to 3 m. The results for the 30 mm 789 are shown in FIG. 2. The conventional range sensing methods which are evaluated are labeled on the plots as "time", "turns count", "1D accelerometer", "muz vel corrected time", and "times-turns hybrid", which corresponds to the timing, turns counting, twice-time-integrated one-dimensional accelerometer, corrected timing, and time-turns hybrid range sensing methods, respectively.

Figure 3:
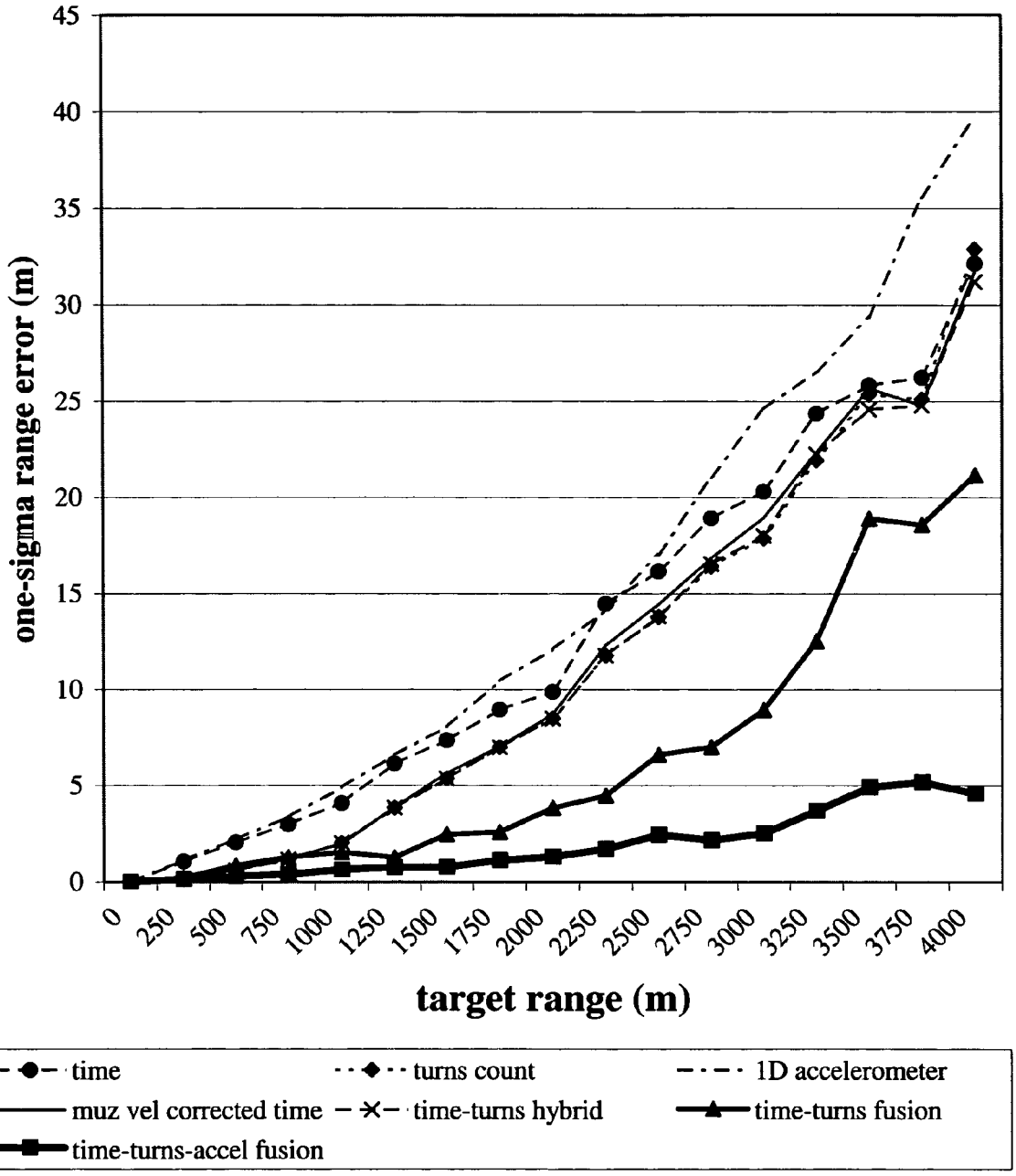
FIG. 3 is a graphical illustration of experimental results achieved according to an embodiment of the invention.
Figure 4:
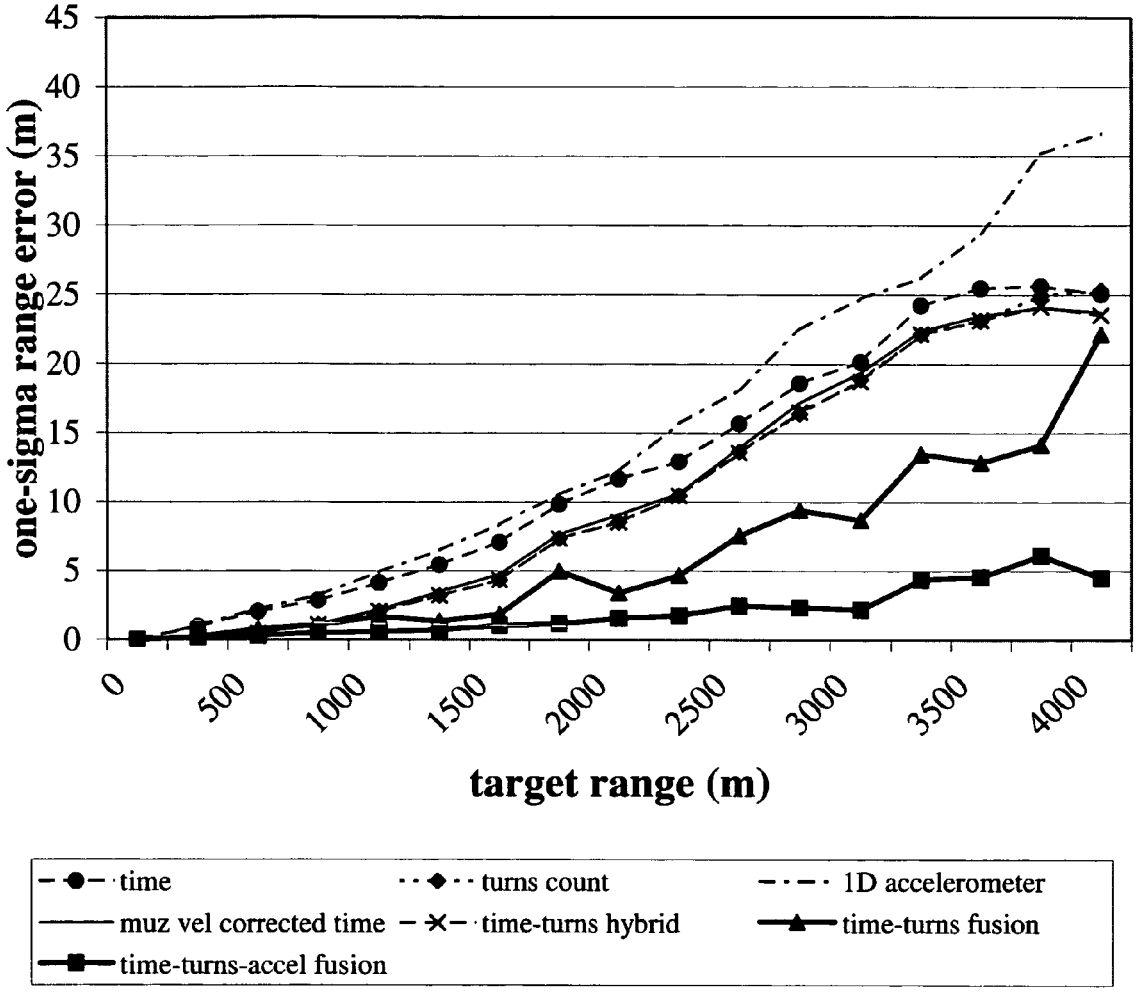
FIG. 4 is a graphical illustration of experimental results achieved according to an embodiment of the invention.
Figure 5:
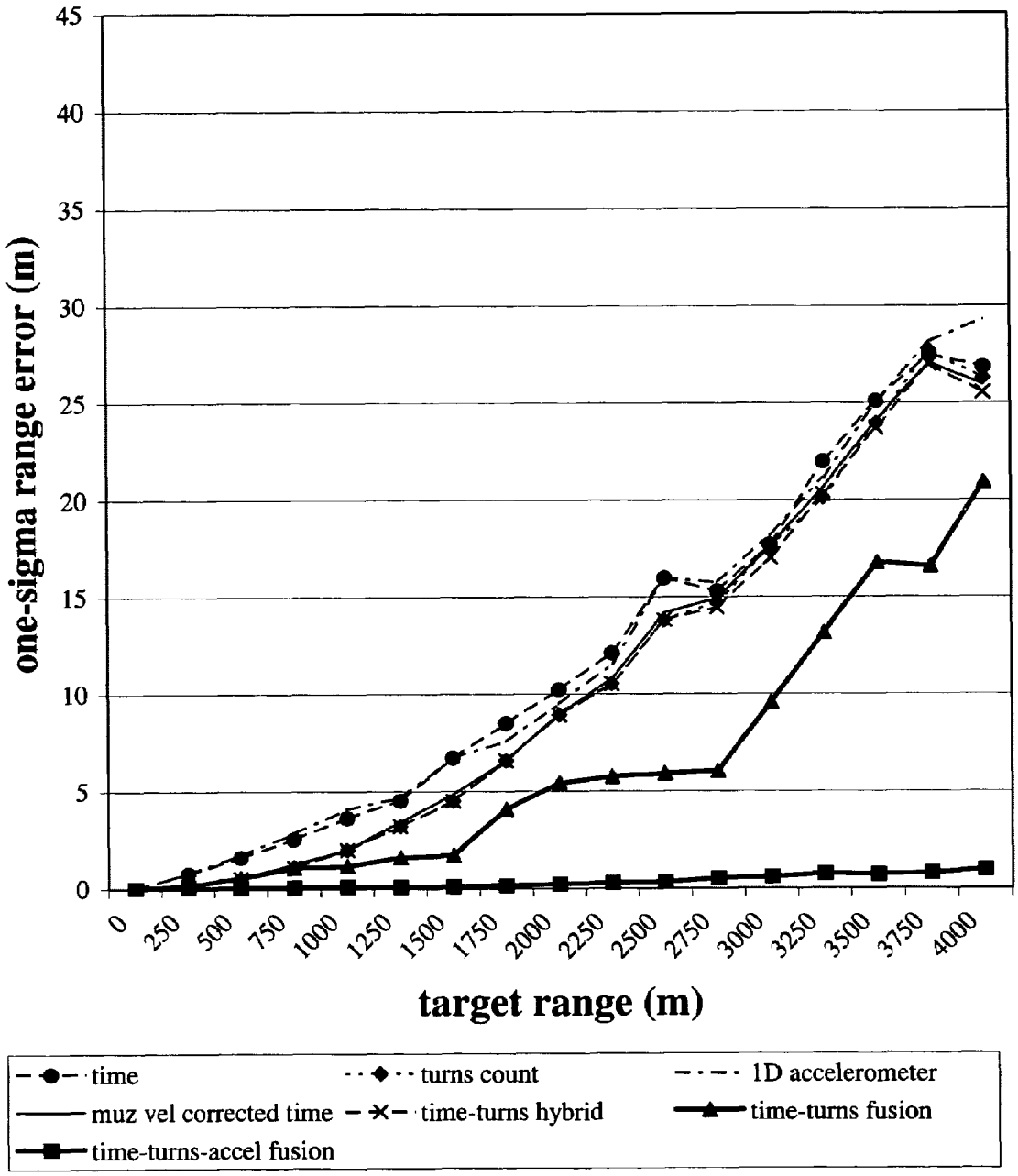
FIG. 5 is a graphical illustration of experimental results achieved according to an embodiment of the invention.
Figure 6:
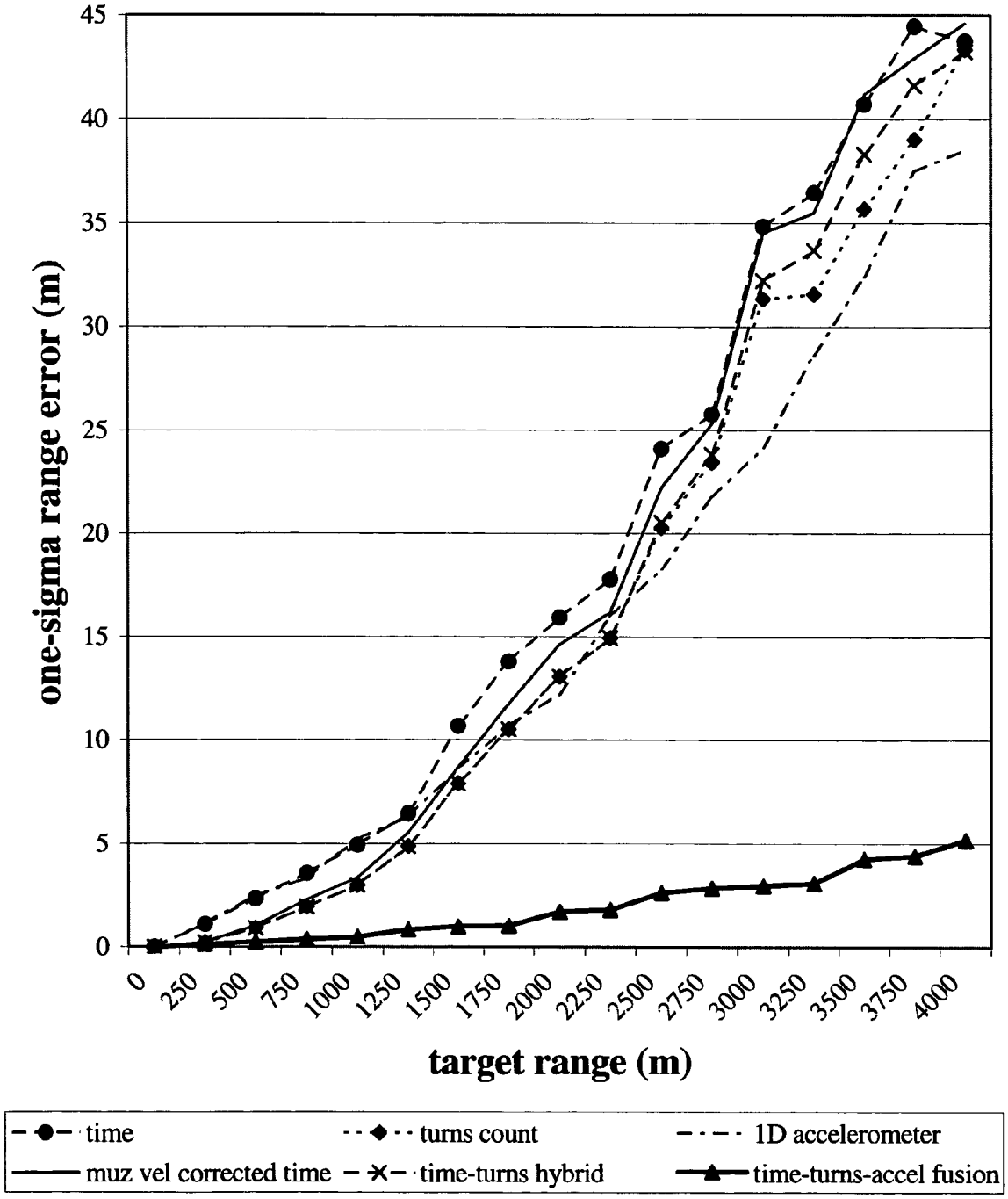
FIG. 6 is a graphical illustration of experimental results achieved according to an embodiment of the invention.

The range sensing methods labeled as "time-turns fusion" and "time-turns-accel fusion" correspond to the application of the invention's sensor fusion filter to a turns counter and a turns counter in conjunction with a one-dimensional accelerometer, respectively. A timer is included in the sensor suite, by default, in all of the cases to which the invention's methodology is applied. FIG. 3 shows the results for the 40 mm "concept 2SW". FIG. 4 shows the results for the 40 mm "concept 12". FIG. 5 shows the results for the 40 mm "concept 12" for which the round-to-round muzzle exit velocity "one sigma" standard deviation (SD) error value is reduced from 3.0 m/s to 1.5 m/s, and the twist "one sigma" error value is reduced from 1% to 0.1%. FIG. 6 shows the results for the 40 mm "concept 12" for which the air temperature and pressure "one sigma" error values are increased to 1.50%, the range and cross wind "one sigma" error values are increased to 3.35 m/s, and the drag/mass round-to-round "one sigma" error value is increased to 0.75%. The "time-turns fusion" fuze is omitted from FIG. 6 for the sake of expediency.

Assuming that one can use "one sigma" range error as a performance metric, then certain trends in the results emerge from the range error versus target range plots. First, the relative difference between the "time-turns-accel fusion" fuze performance, the "time-turns fusion" fuze performance, and the baseline performance using conventional range sensing methods is consistent from munition to munition. Second, the "time-turns fusion" fuze uses mature sensor technology and its performance offers significant improvement over the baseline performance using conventional methods, especially at larger target ranges. Third, the "time-turns-accel fusion" fuze depends on emerging gun-rugged MEMS accelerometer technology[20], but its performance offers significant improvement over the "time-turns fusion" fuze performance, especially at larger target ranges. This supports the reasonable contention that long-range accuracy increases as the number of (non-redundant) sensors fused increases. Fourth, comparison of FIGS. 4, 5, and 6 indicates that the "time-turns-accel fusion" fuze is robust in the sense that its performance is relatively insensitive to changes in the trajectory error source statistics. This is important in that, realistically, one will typically have only imperfect knowledge of the actual statistical behavior of the trajectory error sources.

There are regions in the various plots which indicate a small, local decrease in range error corresponding to an increase in the target range value for both the "time-turns fusion" fuze and the "time-turns-accel fusion" fuze. This seems counter-intuitive, but a possible explanation may be found in the interpolatory nature of the underlying sensor fusion method. If one uses relatively few (fixed) interpolation points in fitting various real-valued functions with a cubic spline, for example, then the accuracy of the resulting interpolation tends to vary from one function to the next, depending upon how well the distribution of those particular interpolation points "capture" each function's variations. The accuracy of such a spline hence fluctuates with the choice of the function being interpolated. If one uses many (fixed) interpolation points, however, then the interpolation becomes more "universal" in that its accuracy is much less sensitive to the choice of function being interpolated (barring extreme pathological choices). If the analogy holds, then the relatively few interpolation "points" J=35 used in generating the plotted results may also lead to accuracy fluctuations that are large enough to effect the statistical results between two "similar" sets of data. On a scale of a few hundred meters in target range the associated trajectory data sets may be sufficiently "similar". Regardless, FIGS. 2 through 6 indicate that the fusion method of the invention outperforms the conventional methods.

Figure 7:
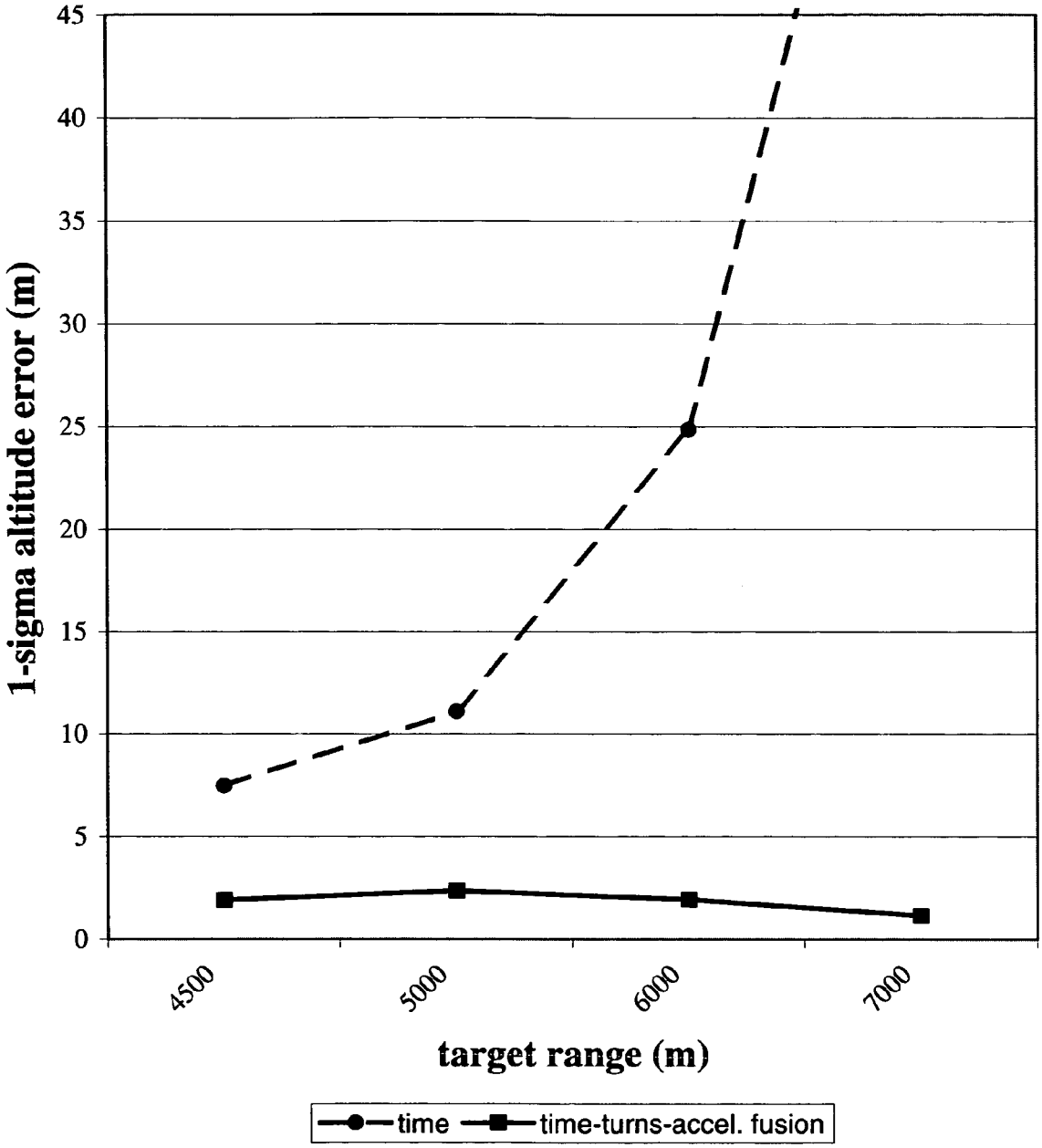
FIG. 7 is a graphical illustration of experimental results achieved according to an embodiment of the invention.
Figure 8:
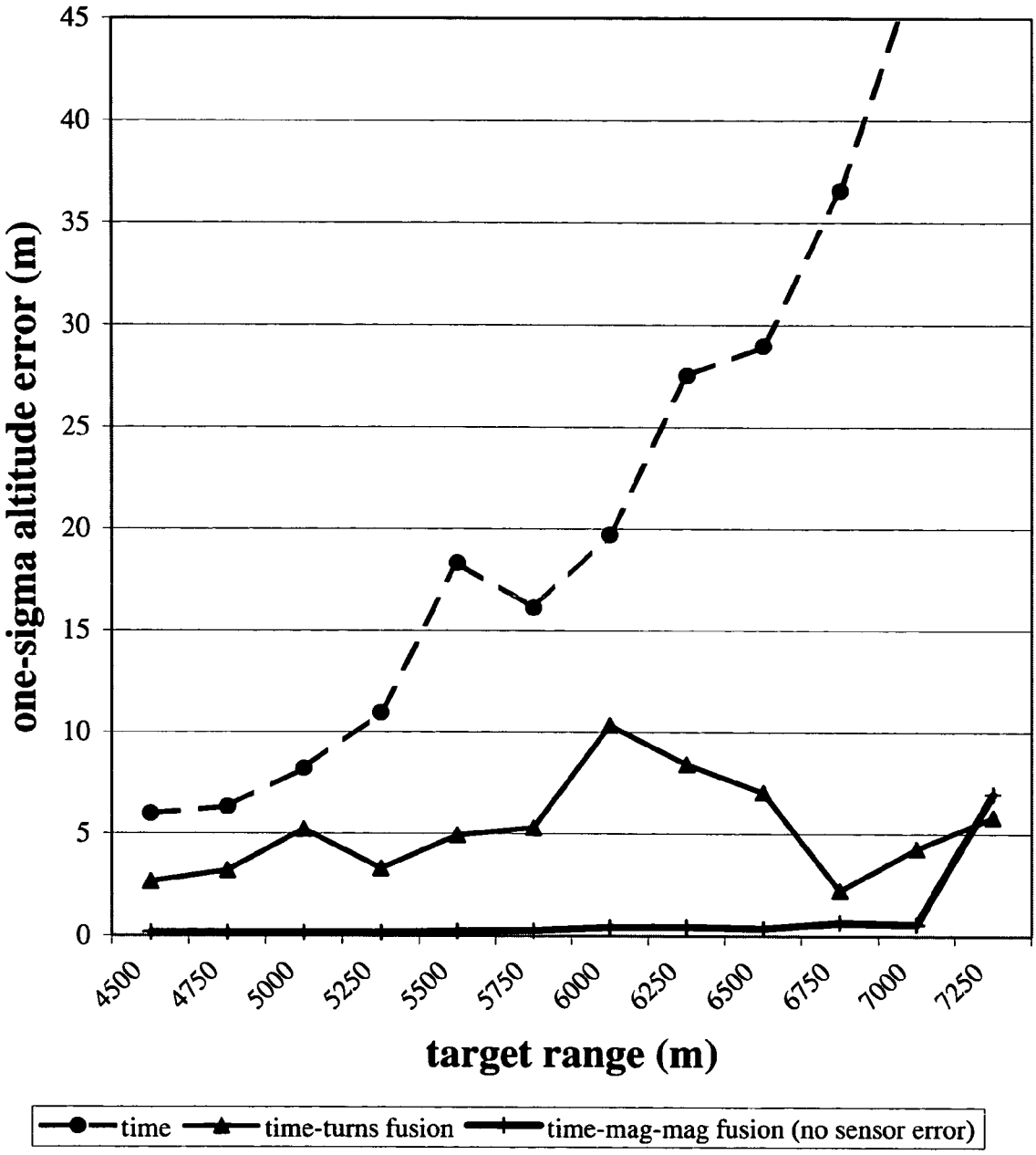
FIG. 8 is a graphical illustration of experimental results achieved according to an embodiment of the invention.

For the altitude sensing results a Monte Carlo simulation of 50 occasions with 10 rounds per occasion is generated for each target range value. The target altitude is again set to 3 m. In FIG. 7 the performance of the "time-turns-accel fusion" fuze for "concept 2SW" is compared to the baseline performance of the conventional timing methods. The errors are plotted for target range values of 4500 m, 5000 m, 6000 m, and 7000 m. The resulting "one sigma" altitude error is less than 3 m for all target range values. The target range values for FIG. 8 occur in 250 m increments, starting at 4500 m, out to a maximum value of 7250 m. The performance of the "time-turns fusion" fuze for "concept 2SW" is compared to the baseline performance of the timing method. Additionally, the altitude sensing method labeled as "time-orientation fusion", which corresponds to the application of the invention's sensor fusion method to a projectile "orientation" sensor signal, is also included. The reason for its inclusion is based upon the intuition that an "orientation" versus time signal would be a powerful trajectory signature in indirect fire (barrage mode) since the projectile's orientation variation would be significant in such cases. The signal used in FIG. 8 is the highly idealized one consisting of the sine of the earth-fixed pitch angle of the projectile. Whereas the results for the "time-turns fusion" fuze are in the 5 m to 10 m range, which is clearly superior to that of the baseline case (timing), the results for the "time-orientation fusion" fuze reflect a "one sigma" altitude error that is less than 1 m for all target range values below 7000 m. These results indicate the potential benefit of the application of the sensor fusion method provided by the invention to orientation sensing for indirect fire.

The filtering ability of the invention's sensor fusion filter method is given by the following case for which $J_g$=35 and $J_n$=10 in Definition [3]. Table 5 shows range error one-sigma results for the "time-turns-accel fusion" fuze for the "concept 2SW" munition, where the accelerometer has a Gaussian-distributed 0-g bias offset value. As previously mentioned, this acceleration signal, including the offset, is double-time-integrated.

TABLE 5

| Effects of Accelerometer Gaussian-Distributed 0-g Bias Offset on Range Error | | | |
|---|---|---|---|
| | one-sigma value for 0-g bias offset | | |
| Target Range | 0 g | 1 g | 10 g |
| 2000 m | 1.502 | 1.490 | 1.490 |
| 3000 m | 2.762 | 2.828 | 2.828 |

The offset value varies from trajectory to trajectory and is a priori unknown to the sensor fusion filter, that is, its value is to be estimated. The value $J_n=0$ is used for the case corresponding to a 0 g one-sigma offset value (no bias). This accounts for the slight decrease in the one-sigma range error at 2000 m as one goes from 0 g to 1 g in Table 5. The turns counter and timer are noiseless. The range error one-sigma values are obtained from a Monte Carlo simulation of 50 occasions with 10 rounds per occasion (a total of 501 trajectories, including the nominal) for each target range value. The maximum accelerometer signal magnitude is approximately 40 g. The one-sigma error source values listed in Tables 1 through 4 are once again used. In this case approximately 3.3 kbytes of data need to be transferred to the projectile prior to firing, as opposed to 2.6 kbytes for the previous (noiseless) results presented.

Additionally, the results of Monte Carlo simulations for the "time-turns-accel fusion" faze for the "concept 2SW" munition at target ranges of 2 km. 3 km, and 4 km indicate consistently superior range-error performance for Monte Carlo interpolation over LMMSE (i.e., linear minimum mean square error) when the number of Monte Carlo runs used to "construct" both is approximately $J_g=60$ or less. The LMMSE "constructed" from 501 Monte Carlo trajectory simulations, however, consistently results in somewhat smaller one-sigma range errors than that of the Monte Carlo interpolation "constructed" from $J_g=35$, particularly at 4 km. The simulated sensors were noiseless in this case.

Figure 9:
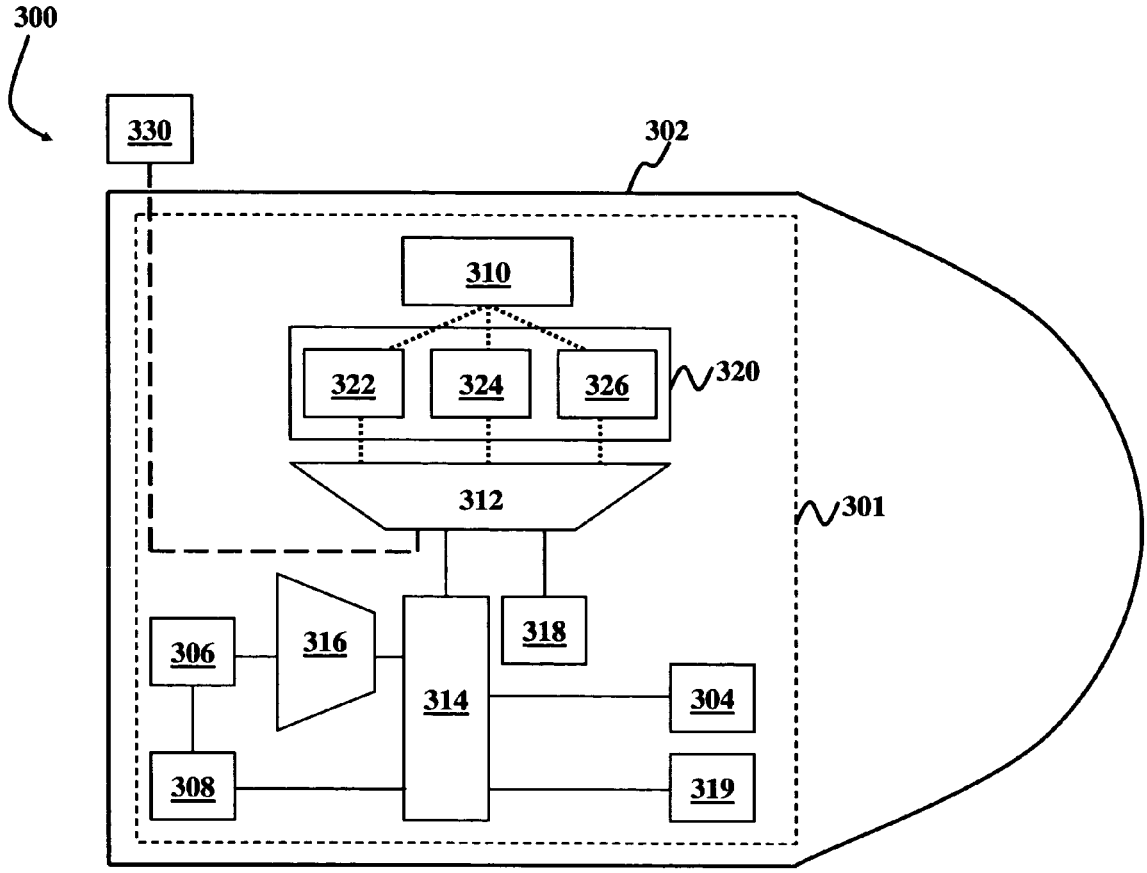
FIG. 9 is a block diagram according to an embodiment of the invention.

A system according to the invention for implementation of the underlying method is illustrated in FIG. 9, wherein the system 300 for tracking a trajectory position of a fuze-sensing projectile 302 comprises a control unit 301 comprising an onboard computer 304 operable for determining pre-launch data affecting a flight of the fuze-sensing projectile 302, wherein the projectile 302 comprises a suite 320 of data sensors. The suite 320 of data sensors comprise a timer 322 operable for generating time data and corrected time data of the projectile 302, a turns counter 324 operable for generating magnetic turns count data of the projectile 302, and an accelerometer 326 operable for generating acceleration data of the projectile 302. The system 300 also comprises a first component 306 operable for predicting a trajectory path of the projectile 302 based on a target location of the projectile 302.

Moreover, the system 300 includes a calculator 308 operable for calculating trajectory path errors based on the predicted trajectory path. FIG. 9 further shows that the system 300 comprises a second component 310 operable for generating in-flight data from each of the data sensors 320. A fusion filter 312 is also provided for combining the in-flight data into a single time-series output. Furthermore, a third component 314 is included in the system 300 for determining a trajectory position of the projectile 302 based on the single time-series output, pre-launch data, and the trajectory path errors. The system 300 further comprises a comparator 316 operable for comparing the trajectory position with the predicted trajectory path, an analyzer 318 operable for analyzing the in-flight data to gauge successful navigation of the projectile 302 to the target location, and a guidance control system 319 operable for self-guiding the projectile 302 to the target location based on the trajectory position. Additionally, the pre-launch data, the target location, predicted trajectory path data, and trajectory path error data are transmitted to the projectile 302 from a fire control computer 330 remotely located (located in the gun, which is not shown) from the projectile 302 prior to launch.

The average dwell time for the projectile 302, which is determined by the rate-of-fire of the gun system, and the maximum rate of transfer for information between the projectile 302 and the fire control computer 330 together constrain the value of W in equation (56) for any given gun system. Moreover, the computational speed $\zeta$ of the onboard CPU/DSP is preferably sufficiently large such that the time $\delta t_{obc}$ of equation (58) required to perform the invention's method is a reasonably small fraction of the total flight time. Additionally, the memory capacity $\mathcal{M}$ of the onboard CPU/DSP is preferably large enough to satisfy equation (57). Furthermore, accurate and inexpensive gun-rugged MEMS accelerometers and GMR magnetometers are preferably utilized for the sensor suite 320 in order to get the best performance for the sensor fusion filter of the invention. Also, preferably the computational capability of the fire control computer 330 is such that the offline computations and online input methodologies can be performed in real time.

Figure 10:
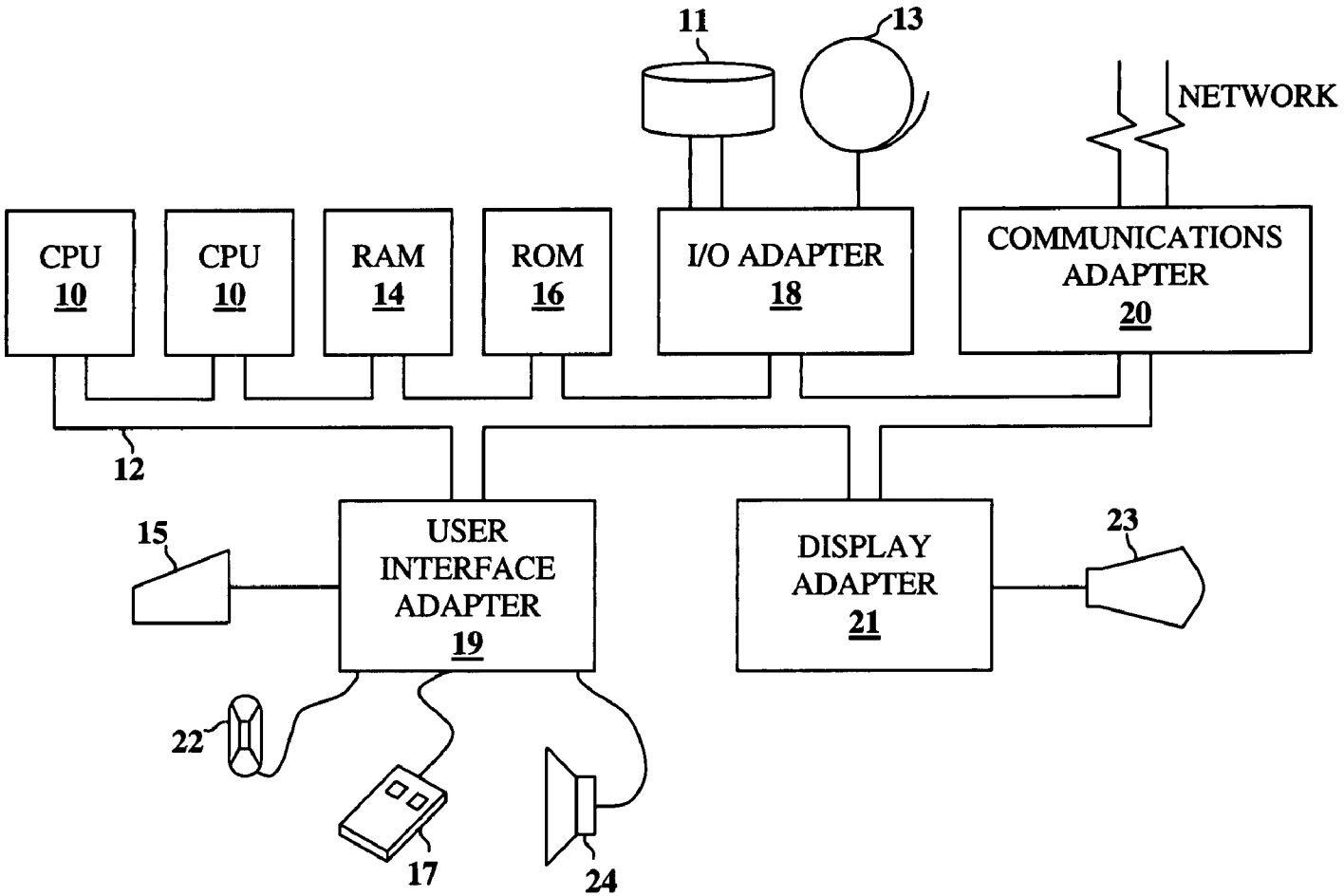
FIG. 10 is a system diagram according to an embodiment of the invention.

A representative hardware environment for practicing the present invention is depicted in FIG. 10, which illustrates a typical hardware configuration of an information handling/computer system in accordance with the invention, having at least one processor or central processing unit (CPU) 10. The CPUs 10 are interconnected via system bus 12 to random access memory (RAM) 14, read-only memory (ROM) 16, an input/output (I/O) adapter 18 for connecting peripheral devices, such as disk units 11 and tape drives 13, to bus 12, user interface adapter 19 for connecting keyboard 15, mouse 17, speaker 24, microphone 22, and/or other user interface devices such as a touch screen device (not shown) to bus 12, communication adapter 20 for connecting the information handling system to a data processing network, and display adapter 21 for connecting bus 12 to display device 23. A program storage device readable by the disk or tape units is used to load the instructions, which operate the invention, which is loaded onto the computer system.

Essentially, the invention provides a sensor fusion methodology with application to fuze-sensing in medium caliber unguided munitions. In this regard, the invention has broad application to various types of combat systems. In particular, the methodology provided by the invention represents a novel approach in long-range fuze-sensing of range or altitude for gun systems. The invention has potential future use as a range-sensing fuze, an altitude-sensing fuze, or both (dual-use). In general, however, the invention is potentially useful for any application that requires the accurate sensing of projectile position as a function of time-from-launch, whatever the caliber.

The invention's direct fire range sensing accuracy is supported by the range error results of section illustrated in FIGS. 2 through 6, which show an order-of-magnitude decrease in range error for turns-count/1D-accelerometer fusion over conventional methods at target ranges in excess of 3 km. In several plots the range error is approximately 5 m at a target range of 4 km, the largest target range studied. Much of the invention's sensor fusion filter's success over conventional range sensing methods stems from its ability to handle multiple error sources simultaneously. Moreover, the invention's potential for indirect fire (barrage mode) altitude sensing accuracy is supported by the altitude error results graphically illustrated in FIGS. 7 and 8, which show an altitude error of less than 1 m at a target range of 7 km for (idealized) orientation fusion, further indicating the advantages of the invention.

The invention indicates that combining the output of several independent fuze sensors lead to both improved accuracy and greater robustness. Thus, the invention provides a sensor fusion methodology to overcome the limitations of the conventional fuze-sensing methods. Numerous Monte Carlo simulations testing the validity of the invention indicate that the invention can both make use of, and improve upon, current timer and GMR magnetometer sensor technology. As MEMS accelerometer and other sensor technologies mature for gun rugged use, they can easily be added to existing onboard sensor suites. As such, the invention can then be used to combine their time-series outputs into a single, collective time-to-detonate decision that is even more robust and accurate than before.

In addition to these small/medium caliber benefits, the invention provides potentially cheaper, more compact, non-jammable, low power alternatives to existing fuze sensors even for large caliber munitions. For example, a GPS based fuzing system, which can be jammed, may be replaced by a collection of cheaper, non-jammable sensors (timing, turns counting, etc.) whose collective fuzing performance is made comparable to that of GPS by application of the invented method. Similarly, the conventional HOB proximity sensor, which is jammable and also susceptible to premature detonation due to tree clutter, may also be replaced by a collection of cheaper, smaller, non-jammable sensors, which are accurate even for ground targets within dense forests. Finally, the invention accounts for and corrects multiple error sources simultaneously and provides for an accurate longer range (1500 m and beyond) range-sensing and/or altitude-sensing fuzes, which also satisfy the practical constraints associated with small/medium caliber, air bursting munitions.

The sensor fusion output of the invention may be used as an accurate range-sensing fuze for direct fire use, altitude-sensing fuze for barrage use, and/or dual-use fuze that combine both capabilities. As the method itself is independent of the number of, or nature of, the onboard sensors, it can form the basis of a universal fuze design for all calibers of munitions, a long sought goal of the munitions fuze community. The invention may also be used in determining aerodynamic coefficients from in-flight sensor data for prototype munitions during field tests. Also, the invention may be used as a trajectory path sensor for use in active flight control/correction as well. In general, the method is useful for any application that requires the accurate sensing of projectile position as a function of time-from-launch.

As mentioned, conventional fuzing methodologies use a computed nominal trajectory simulation, based upon nominal initial/Met conditions, to determine either a time-to-target or a turns-count-to-target value, which is communicated to the projectile before firing. In conventional systems, the onboard sensor, either a timer or a turns-counter, may serve as a gauge as to when this value has been reached by the projectile during flight. Potentially valuable sensor information may not be utilized. In addition, the nominal trajectory simulation used may be significantly in error due to the accumulated effect of numerous error sources, which would perturb the actual flight path of the projectile from that of the nominal one. Efforts to fix this conventionally may consist of singling out one of the major sources of error, such as variations in muzzle exit velocity, and minimizing its effects. This has been done either by using turns counting, which is velocity insensitive, or by directly measuring muzzle exit velocity in the projectile during its launch and "correcting" the previously obtained time-to-target for this error. In contrast, the invention uses the nominal initial/Met conditions, pre-launch-computed "sensitivity data" for the various error sources, and the in-flight sensor output all together to least-squares-synthesize an accurate nominal trajectory for use in determining flight path (position) versus time and hence, if desired, time-to-target. This effectively amounts to real-time, in-flight system identification. Clearly, this has the potential to account for all of the sources of error simultaneously, not just muzzle exit velocity, and which fully utilizes the information content of the onboard sensors output.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the invention has been described in terms of preferred embodiments, those skilled in the art will recognize that the invention can be practiced with modification within the spirit and scope of the appended claims.

REFERENCES

[1] Harkins, T. E., et al., "MAGSONDE: A Device for Making Angular Measurements on Spinning Projectiles Via Magnetic Sensors," Technical Report ARL-TR-2310, U.S. Army Research Laboratory, Aberdeen Proving Ground, MD, December 2000.

[2] Arrow Tech Associates, Inc., South Burlington, Vt., PRODAS2000 User Manual, Version 2.2.19.

[3] Lieske, R. F., et al., "Equations of Motion for a Modified Point Mass Trajectory," Technical Report BRL-TR-1314, U.S. Army Ballistic Research Laboratory, Aberdeen Proving Ground, MD, March 1966.

[4] Arrow Tech Associates, Inc., South Burlington, Vt., PRODAS2000 Module: ARL Fuzing System Simulation, Version 2.0.0 (2001).

[5] Eykhoff, P., "System Identification: Parameter and State Estimation," John Wiley, New York (1974).

[6] Bar-Shalom, Y., et al., "Estimation with Applications to Tracking and Navigation: Theory, Algorithms, and Software," John Wiley, New York (2001).

[7] Julier, S. J., et al., "A New Approach for Filtering Nonlinear Systems," In Proc. of the 1995 American Control Conference, pp. 1628–1632, Seattle Wash., June 1995.

[8] Wan, E. A., et al., "The Unscented Kalman Filter for Nonliner Estimation," In Proc. of IEEE Symposium 2000 (AS-SPCC), pp. 153–158, Lake Louise, Alberta, Canada, October 2000.

[9] Doucet, A., et al., "Sequential Monte Carlo Methods in Practice," Springer-Verlag, New York (2001).

[10] Hall, D., "Mathematical Techniques in Multisensor Data Fusion," Artech House, Boston (1992).

[11] Crandall, S. H., "Engineering Analysis", McGraw-Hill, New York (1956).

[12] Zienkiewicz, O. C., "The Finite Element Method, 3rd Ed.," McGraw-Hill, London (1977).

[13] Lancaster, P., "The Theory of Matrices with Applications," Academic Press, Orlando (1985).

[14] Peressini, A. L., et al., "The Mathematics of Nonlinear Programming," Springer-Verlag, New York (1988).

[15] Golub, G. H., et al., "Matrix Computations, 3rd Ed.," Johns Hopkins University Press, Baltimore (1996).

[16] Flippen, L. D., "Initial-Interval Driven Biasing of Nodal Concentration Along a Fixed Curve," Computers and Structures, 70, No. 6, pp. 691–698, 1999.

[17] Wilson, M., "Window Interface Language Reference Manual," Wilson WindowWare, Inc., Seattle, Wash. (January 2000).

[18] Wolfram, S., "The Mathematica Book, 4th Ed.," Cambridge University Press, New York (1999).

[19] Whyte, B., Arrow Tech Associates, Inc., South Burlington, Vt., September 2002.

[20] Davis, B. S., et al., "Shock Experiment Results of the DFuze 8-Channel Inertial Sensor Suite that Contains Commercial Magnetometers and Accelerometers," Memorandum Report ARL-MR-532, U.S. Army Research Laboratory, Aberdeen Proving Ground, MD, April 2002.

[21] Hepner, D. J., et al., "Determining Inertial Orientation of a Spinning Body with Body-Fixed Sensor," Technical Report ARL-TR-2313, U.S. Army Research Laboratory, Aberdeen Proving Ground, MD, January 2001.

[22] Thompson, A. A., "A Point-wise Solution for the Magnetic Field Vector," Technical Report ARL-TR-2633, U.S. Army Research Laboratory, Aberdeen Proving Ground, MD, January 2002.

[23] Thompson, A. A., "A Procedure for Calibrating Magnetic Sensors," Memorandum Report ARL-MR-524, U.S. Army Research Laboratory, Aberdeen Proving Ground, MD, January 2002.

[24] Hull, D., U.S. Army Research Laboratory, Adelphi, Md., August 2001.

What is claimed is:

1. A method of tracking a self-sensing projectile to a target location, the method comprising:

determining pre-launch data affecting a flight of the projectile, the projectile comprising a plurality of independent data sensors;

predicting a trajectory path of the projectile based on a target location for the projectile;

projecting trajectory path errors based on the target range and altitude location, and the predicted trajectory path;

generating on-board, in-flight data from each of the data sensors;

combining the in-flight data into a single time-series output; and on-board tracking of the trajectory position of the projectile based on the single time series output, the pre-launch data, and the projected trajectory path errors.

2. The method of claim 1, further comprising comparing the tracked trajectory path with the predicted trajectory path.

3. The method of claim 1, further comprising analyzing the in-flight data to gauge successful navigation of the projectile to the target location.

4. The method of claim 1, further comprising self-guiding the projectile to the target location based on the trajectory position.

5. The method of claim 1, wherein the pre-launch data comprises range wind data, crosswind data, temperature data, and pressure data.

6. The method of claim 1, wherein the target location comprises a target range and a target altitude location.

7. The method of claim 1, wherein the step of combining occurs in a fusion filter.

8. The method of claim 1, wherein the data sensors comprise a timer operable for generating time data and corrected time data of the projectile.

9. The method of claim 1, wherein the data sensors comprise a turns counter operable for generating magnetic turns count data of the projectile.

10. The method of claim 1, wherein the data sensors comprise an accelerometer operable for generating acceleration data of the projectile.

11. The method of claim 1, wherein the pre-launch data, the target location, predicted trajectory path data, and projected trajectory path error data are transmitted to the projectile from a fire control computer remotely located from the projectile prior to launch.

12. The method of claim 1, wherein the projectile comprises any of air bursting munitions, ballistic munitions, and unguided munitions.

13. The method of claim 1, wherein the self-sensing comprises fuze-sensing.

14. The method of claim 1, wherein the self-sensing comprises range sensing, altitude sensing, and a combination of both.

15. The method of claim 1, wherein the step of combining in-flight data produces a collective prediction of the trajectory position as a function of time-from-launch.

16. The method of claim 1, wherein the step of combining comprises a fusion of time-sampled outputs from an arbitrary suite of the data sensors.

17. The method of claim 16, wherein the time-sampled outputs comprise a time-labeled, finite sequence of real numbers for a pre-determined set of unique time sample values.

18. The method of claim 1, wherein the trajectory path errors comprise multiple errors from multiple sources, wherein the multiple errors are simultaneously calculated from each of the multiple error sources.

19. A method for tracking a trajectory position of a fuze-sensing projectile, the method comprising:

determining a target range and target altitude location for the projectile, wherein the projectile comprises a plurality of data sensors;

predicting a trajectory path of the projectile based on the target range and altitude location;

determining initial conditions data affecting the projectile prior to launch;

projecting trajectory path errors based on the predicted trajectory path, the target range and altitude location, and the initial conditions data;

generating in-flight sensor output data generated by each of the data sensors;

combining the in-flight sensor output data into a single time-series output calculation; and determining a trajectory flight position of the projectile based on a combination of the initial conditions data, the single time-series output calculation, and the projected trajectory path errors.

20. A system for tracking a trajectory position of a fuze-sensing projectile comprising:

means for determining pre-launch data affecting a flight of the fuze-sensing projectile, the projectile comprising a plurality of independent data sensors;

means for predicting a trajectory path of the projectile based on a target location of the projectile;

means for estimating trajectory path errors based on the predicted trajectory path and target location;

means for generating in-flight data from each of the data sensors;

means for combining the in-flight data into a single time-series output; and means for determining a trajectory position of the projectile based on the single time-series output, pre-launch data, and the trajectory path errors.

21. The system of claim 20, further comprising means for comparing the trajectory position with the predicted trajectory path.

22. The system of claim 20, further comprising means for analyzing the in-flight data to gauge successful navigation of the projectile to the target location.

23. The system of claim 20, further comprising means for self-guiding the projectile to the target location based on the trajectory position.

24. The system of claim 20, wherein the pre-launch data comprises range wind data, crosswind data, temperature data, and pressure data.

25. The system of claim 20, wherein the target location comprises a target range aid a target altitude location.

26. The system of claim 20, wherein die data sensors comprise a timer operable for generating time data and corrected time data of the projectile.

27. The system of claim 20, wherein the data sensors comprise a turns counter operable for generating magnetic turns count data of the projectile.

28. The system of claim 20, wherein the data sensors comprise an accelerometer operable for generating acceleration data of the projectile.

29. The system of claim 20, wherein the projectile comprises any of air bursting munitions, ballistic munitions, and unguided munitions.

30. The system of claim 20, wherein fuze-sensing comprises range sensing, altitude sensing, and a combination of both.

31. The system of claim 20, wherein the time-sampled output comprises a time-labeled, finite sequence of real numbers for a pre-determined set of unique time sample values.

32. The system of claim 20, wherein the trajectory path errors comprise multiple errors from multiple sources, wherein the multiple errors are simultaneously calculated from each of the multiple error sources.

* * * * *